US012281485B2

(12) United States Patent
Winter

(10) Patent No.: US 12,281,485 B2
(45) Date of Patent: Apr. 22, 2025

(54) ELEMENT RECEPTACLE

(71) Applicant: PERI SE, Weissenhorn (DE)

(72) Inventor: Franz Winter, Weissenhorn (DE)

(73) Assignee: PERI SE, Weissenhorn (DE)

( * ) Notice: Subject to any disclaimer, the term of this patent is extended or adjusted under 35 U.S.C. 154(b) by 14 days.

(21) Appl. No.: 18/261,538

(22) PCT Filed: Jan. 4, 2022

(86) PCT No.: PCT/EP2022/050079
§ 371 (c)(1),
(2) Date: Jul. 14, 2023

(87) PCT Pub. No.: WO2022/152594
PCT Pub. Date: Jul. 21, 2022

(65) Prior Publication Data

US 2024/0084609 A1 Mar. 14, 2024

(30) Foreign Application Priority Data

Jan. 15, 2021 (DE) ..... 20 2021 100 196.8

(51) Int. Cl.
*E04G 7/02* (2006.01)

(52) U.S. Cl.
CPC ..... *E04G 7/02* (2013.01)

(58) Field of Classification Search
CPC ..... E04G 7/02; E04G 7/06; E04G 7/26
See application file for complete search history.

(56) References Cited

U.S. PATENT DOCUMENTS 11,208,815 B2 * 12/2021 Rogers ..... E04G 7/02
2013/0330117 A1 * 12/2013 Kreller ..... E04G 7/02 403/49
2019/0390470 A1 12/2019 Rogers

FOREIGN PATENT DOCUMENTS

| | | |
|---|---|---|
| CH | 361390 | 4/1962 |
| DE | 102004051614 | 4/2006 |
| GB | 2379229 | 3/2003 |
| GB | 2394748 | 5/2004 |

OTHER PUBLICATIONS

"Gerüst Programmübersicht", Firmenschrift, Peri GMBH, D-89259 Weissenhorn, DE, (Oct. 1, 2010), pp. 1-164, XP008173230.
"Gerüst Programmübersicht", Firmenschrift, Peri GMBH, D-89259 Weissenhorn, DE, (Oct. 1, 2010), pp. 1-164, XP008173230 (English Translation of German Document).

(Continued)

*Primary Examiner* — Anita M King
(74) *Attorney, Agent, or Firm* — SLEMAN & LUND LLP

(57) ABSTRACT

An element receptacle for providing a receptacle for a scaffolding element on a scaffolding element already positioned, the element receptacle including a receptacle which has a receptacle interface for receiving a scaffolding element which also has at least one joint region disposed adjacent to receiving interface, and which also has a clamping region disposed adjacent to the joint region on the side of the receptacle opposite the receptacle interface. The element receptacle also includes a retainer which has an attaching element for attaching to a scaffolding element already positioned, and which also has at least one mating joint region.

19 Claims, 4 Drawing Sheets

(56) References Cited

OTHER PUBLICATIONS

Figure 1:
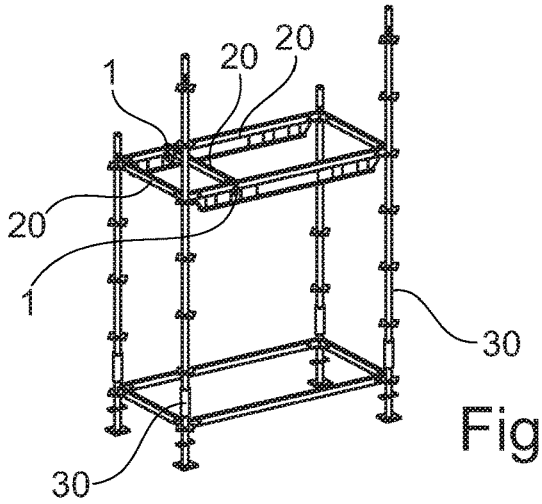

"Gerüstbauteile für das Modulsystem", Peri Up Flex, Riegelaufnahme UHA, DIBt Z-8.22 (Apr. 5, 2019), pp. 1-36.
"Gerüstbauteile für das Modulsystem", Peri Up Flex, Riegelaufnahme UHA, DIBt Z-8.22 (Apr. 5, 2019), pp. 1-36 (English Translation of German Document).

* cited by examiner

ELEMENT RECEPTACLE

The invention relates to an element receptacle for providing a receptacle for a scaffolding element on a scaffolding element already positioned comprising a receptacle which has a receptacle interface for receiving a scaffolding element which also has at least one joint region disposed adjacent to the receiving interface, and which also has a clamping region disposed adjacent to the joint region on the side of the receptacle opposite the receptacle interface. The element receptacle also comprises a retainer which has an attaching element for attaching to a scaffolding element already positioned, and which also has at least one mating joint region. In the element receptacle, the joint region of the receptacle is inserted into the mating joint region of the retainer, or the mating joint region of the retainer is inserted into the joint region of the receptacle, and, by means of this operative connection between the joint region and the mating joint region, the receptacle is guided for rotation relative to the retainer about at least one first spatial axis. The invention also relates to a connection system for connecting a scaffolding portion to a scaffolding portion already positioned comprising at least one element receptacle and at least one first horizontal bar, as well as to a method for mounting a scaffolding portion to a scaffolding portion already positioned.

In the building sector, scaffoldings are used for various purposes. Facade scaffoldings serve to create, for example, to paint the outer surfaces of buildings. Moreover, elements required for erecting constructions such as temporary constructions or formwork may be positioned with the aid of support scaffoldings. Finally, scaffoldings are also deployed in the service or revision sector, for example, to safely get personnel to the facility parts to be revised in large process-related plants such as refineries.

Scaffoldings comprise horizontally oriented levels on which working persons can remain and move. These horizontal levels are formed by horizontal bars attached to vertically extending scaffolding elements, for example vertical posts, in the horizontal direction. For example, a horizontal level may be formed by a frame of four horizontal bars arranged at right angles relative to each other. On such a frame, various coverings may be arranged which will then form the treading surface of the level. However, in specific applications, such simple rectangular frames of horizontal bars are not sufficient. For example, openings rendering a passage of persons having to move upwards or downwards in the scaffolding possible may be required in a horizontal level. Moreover, there are other applications in which only a section of a rectangular frame is to be provided with a treading covering. Finally, there is sometimes the requirement to enlarge the horizontal level outside of such a rectangular frame of horizontal bars. For these applications mentioned by way of example, so-called bar receptacles exist which are attached to a horizontal bar already positioned and provide for a receptacle for mounting another horizontal bar. With the aid of such bar receptacles, frames of already positioned horizontal bars can be extended and modified.

An example of such a bar receptacle according to prior art is the bar receptacle UHA produced by the applicant which is provided for an attachment to horizontal bars of the series UH or UHV and renders the connection of another horizontal bar of this or a similar design possible. This known bar receptacle UI-IA is mounted to an already positioned horizontal bar with the aid of a hook and, in sections, non-positively connected to the horizontal bar with the aid of a clamping plate. A disadvantage of the known bar receptacle is that its attachment to the already positioned horizontal bar is relatively complicated to perform. Moreover, the known bar receptacle exhibits a clearance to the already positioned horizontal bar in some applications so that other scaffolding elements attached to the bar receptacle exhibit undesired degrees of freedom and can move relative to the already positioned horizontal bar.

It is therefore the object of the invention to propose solutions by means of which the connection of another scaffolding element, for example of a horizontal bar, to an already positioned scaffolding element, for example a horizontal bar, is facilitated and improved with respect to the load transfer.

The object of the invention is solved by an element receptacle for providing a receptacle for a scaffolding element on a scaffolding element already positioned comprising:

a receptacle which has a receptacle interface for receiving a scaffolding element which also has at least one joint region disposed adjacent to receiving interface, and which also has a clamping region disposed adjacent to the joint region on the side of the receptacle opposite the receptacle interface, and a retainer which has an attaching element for attaching to a scaffolding element already positioned, and which also has at least one mating joint region, the joint region of the receptacle being inserted into the mating joint region of the retainer or the mating joint region of the retainer being inserted into the joint region of the receptacle, and the receptacle, by means of this operative connection between joint region and mating joint region, being guided for rotation relative to the retainer about at least one first spatial axis. The retainer further includes an abutment surface disposed on the side of the retainer facing away from the receptacle interface, the attaching element protruding beyond the abutment surface on the side of the retainer facing away from the receptacle interface, and the attaching element and the mating joint region being disposed on opposite sides of the abutment surface. The receptacle comprises a gripping surface disposed on the side of the receptacle facing the attaching element, the receptacle interface and the clamping region being disposed on opposite sides of the gripping surface, a first clamping section of the clamping region protruding beyond the gripping surface in the direction of the attaching element, and a second clamping section protruding beyond the surface disposed opposite of the gripping surface.

An element receptacle according to the invention comprises the assemblies receptacle and retainer. The receptacle and the retainer are connected to each other so that they are movable relative to each other. The element receptacle according to the invention is capable of providing a receptacle for a scaffolding element on an already positioned scaffolding element. In the following, a horizontal bar of a facade scaffolding is described as an example of a scaffolding element and used for explanation. In the following illustration, it will be described how a horizontal bar can be attached to an already positioned horizontal bar with the aid of the element receptacle according to the invention. However, the use of the element receptacle according to the invention is not limited to this example. An element receptacle according to the invention may also be used for providing a receptacle for other scaffolding elements. Moreover, the element receptacle according to the invention may also be placed on a scaffolding element other than a horizontal bar and provide for a receptacle there. A receptacle is to be understood to be an interface capable of accommodating another scaffolding element. Here, the other scaffolding element is typically fixed on or in the receptacle so that a fixed connection is established between element receptacle and the other scaffolding element.

The receptacle constitutes a first assembly of the element receptacle according to the invention. The receptacle comprises a receptacle interface provided for receiving a scaffolding element. In a simple embodiment, the receptacle interface may be implemented as a recess or opening in the receptacle. The receptacle further comprises at least one joint region disposed adjacent to the receptacle interface. The joint region is provided for the movable connection to the second assembly of the element receptacle, the retainer. The receptacle further comprises a clamping region which also adjoins the joint region but is disposed on the side of the joint region disposed opposite of the receptacle interface. The clamping region is provided to be non-positively connected to the scaffolding element to which the element receptacle is attached.

The element receptacle according to the invention comprises the retainer as the second assembly. This retainer includes an attaching element. When the element receptacle is attached to an already positioned scaffolding element the attaching element of the retainer is mounted on this already positioned scaffolding element and therefore serves a first attachment of the element receptacle to the already positioned scaffolding element. The retainer further comprises at least one mating joint region which is provided to be movably connected to the joint region of the receptacle.

The receptacle and the retainer are connected to each other so that either the joint region of the receptacle is inserted into the mating joint region of the retainer or, alternatively, the mating joint region of the retainer is inserted into the joint region of the receptacle. In both alternatives, the receptacle and the retainer are positively connected to each other. However, this connection allows for a relative movement among the two assemblies. The operative connection between the two assemblies, particularly the operative connection between the joint region and the mating joint region, is implemented so that the receptacle is rotatable or pivotable relative to the retainer about at least one first spatial axis. This relative movability among the retainer and the receptacle is required when the element receptacle is attached to an already positioned scaffolding element. Here, the operative connection of the joint region and the mating joint region guides the relative movability among the two assemblies.

The retainer of an element receptacle according to the invention has an abutment surface which, in a mounted state of the retainer and the receptacle, faces away from the receptacle interface disposed in the receptacle. The abutment surface is disposed on a side of the retainer facing away from the receptacle interface. The attaching element provided for mounting the element receptacle on an already positioned scaffolding element is disposed on the same side of the retainer as the abutment surface and protrudes beyond the abutment surface. Here, the attaching element and the mating joint region of the retainer are disposed on opposite sides of the abutment surface. The abutment surface is therefore located between the mating joint region and the attaching element. The abutment surface and the attaching element together enclose a space in which, when the element receptacle is connected to an already positioned scaffolding element, this already positioned scaffolding element is accommodated.

The receptacle comprises a gripping surface which, in the state connected to an already positioned scaffolding element, encloses part of this already positioned scaffolding element. The gripping surface is disposed on the side of the receptacle facing the attaching element of the retainer. The gripping surface is disposed between the clamping region and the receptacle interface of the receptacle. The clamping region in turn comprises a first clamping section and a second clamping section. A first clamping section of the clamping region protrudes beyond the gripping surface in the direction of the attaching element. A second clamping section protrudes beyond the surface disposed opposite of the gripping surface on the opposite side. The clamping region therefore extends in two oppositely oriented directions relative to the gripping surface and the joint region. Preferably, the two assemblies, the retainer and the receptacle, are respectively designed so that they are inherently rigid and only movable relative to each other. When attaching the element receptacle according to the invention, first, the retainer and the receptacle are positioned around an already positioned scaffolding element, the relative movability the two assemblies relative to each other being utilised. After a completed positioning of the retainer and the receptacle on the already positioned scaffolding element, then, another scaffolding element is inserted into the receptacle interface. With this insertion of the other scaffolding element into the receptacle interface, the element receptacle according to the invention is non-positively and positively positioned around the already positioned scaffolding element so that a fixed connection is established between the element receptacle and the already positioned scaffolding element. The other scaffolding element is then fixedly connected to the receptacle interface of the receptacle.

The element receptacle according to the invention is simply formed of two assemblies disposed so that they are movable relative to each other. In this way, the element receptacle is easy to produce at low costs. Moreover, even though the two assemblies of the element receptacle are movable relative to each other, they are captively connected to each other. This considerably facilitates the handling of the element receptacle on the construction site as compared to prior art. During transport and attachment, no components can get lost. Moreover, the attachment of the element receptacle to an already positioned scaffolding element can also be performed in a simple manner with one hand. For the attachment, no tool is required, all required steps during the attachment can be manually performed. Here, the prepositioning of the element receptacle is performed manually. The clamping of the element receptacle on the already positioned scaffolding element is then performed during the insertion of the other scaffolding element into the receptacle interface of the receptacle. With this insertion of the other scaffolding element, a non-positive, stable connection between the element receptacle and the already positioned scaffolding element is established. For establishing the connection, no tool is required here either which considerably facilitates the handling of the element receptacle as compared to the known prior art. The established connection is clearance-free so that a direct transmission of forces between the element receptacle and the two scaffolding elements is given. The connection does no longer exhibit any degrees of freedom so that it is extremely stable and reliable. This clearance-free, non-positive connection is particularly advantageous when a panel is to be attached to an already positioned scaffolding element with the aid of the element receptacle. Moreover, in case of a connection of the element receptacle according to the invention to an already positioned scaffolding element, a non-positive connection is established in which a flow of forces flows through the components on different paths which further increases the stability of the connection. For example, part of the flow of forces is guided through the first clamping section, and another part of the flow of forces is guided through the second clamping section between the element receptacle and the already positioned scaffolding element or the other scaffolding element. However, the flow of forces is guided through the components connected to each other through short and direct paths so that a rigid and stable overall connection is established. Finally, the element receptacle according to the invention is robust and can be easily cleaned so that it is not susceptible to contamination and harsh climatic conditions on the construction site.

In one embodiment, it is contemplated that, due to the operative connection between the joint region and the mating joint region, the receptacle is guided relative to the retainer so that it is linearly movable along at least one second spatial axis. In this embodiment, the two assemblies, the receptacle and the retainer, have a plurality of degrees of freedom relative to each other. On the one hand, the receptacle is designed so that it is rotatably movable relative to the retainer about a first spatial axis. On the other hand, the receptacle is designed so that it is linearly movable relative to the retainer along a second spatial axis. Preferably, the second spatial axis is oriented perpendicular to the first spatial axis here. The guidance or the definition of the degrees of freedom between the retainer and the receptacle is established by the operative connection between joint region and the mating joint region. A relative movability involving rotatability about a first spatial axis and shiftability along a second spatial axis is particularly convenient for an easy and efficient attachment of the element receptacle to an already positioned scaffolding element.

It is contemplated that the receptacle comprises a preferably disc- or tongue-shaped basic body comprising the receptacle interface and the joint region, the clamping region being fixedly connected to the basic body. In this embodiment, the receptacle comprises a basic body designed to be disc- or tongue-shaped. This basic body forms part of the receptacle. Here, disc- or tongue-shaped is to be understood to mean that the basic body has a thickness which is significantly smaller than the length and the width of the basic body. The receptacle interface and the joint region are formed in or on the basic body. The clamping region of the receptacle is fixedly connected to the basic body and protrudes beyond the basic body in two opposite directions.

Furthermore, it is contemplated that the basic body is implemented in a disc shape, and that the receptacle interface is formed by a recess continuously disposed in the basic body. In this embodiment, the receptacle interface is formed by a recess or an opening extending through the basic body. Here, the receptacle interface extends through the basic body in its thickness direction. The thickness direction is the direction on the basic body in which the dimension of the basic body is the smallest.

Skillfully, it is contemplated that the gripping surface is formed by a surface of the basic body and provided to at least sectionally enclose a surface of the already positioned scaffolding element, the gripping surface being defined by the connection interface on one side and by the protruding first clamping section on the opposite side. The gripping surface is a surface brought into abutment on an already positioned scaffolding element when the element receptacle is attached to this already positioned scaffolding element. The gripping surface is formed by a surface of the basic body positioned between the connection interface and the clamping region. Preferably, the gripping surface is designed to be planar. The gripping surface may be made of the same material as the remaining section of the basic body. Optionally, the gripping surface may have a coating improving the adhesion during the installation on the already positioned scaffolding element. For such a coating, plastic or rubber materials are suitable.

Furthermore, it is contemplated that the first clamping section includes a first clamping surface disposed adjacent to the gripping surface and oriented perpendicular to the gripping surface, the first clamping surface being provided for an abutment on a surface of the already positioned scaffolding element. The first clamping section includes a first clamping surface facing the retainer in the connected state of the receptacle and the retainer. The first clamping surface is substantially oriented at a right angle to the gripping surface. Owing to this right angle between the two surfaces, a positive connection to an already positioned scaffolding element having a rectangular cross-section can be established. The gripping surface abuts on an outer wall of the scaffolding element in a state in which the element receptacle is connected to the already positioned scaffolding element, the first clamping surface abuts on a second outer wall adjoining this outer wall. Therefore, the gripping surface and the first clamping surface together enclose two outer walls of the already positioned scaffolding element disposed adjacent and at right angles to each other.

Skillfully, it is contemplated that the second clamping section protrudes beyond the side of the basic body disposed opposite of the gripping surface, the second clamping section being attached to the basic body opposite of the first clamping section, and the end of the second clamping section facing away from basic body being oriented in the direction of the receptacle interface. The two clamping sections protrude beyond the basic body on opposite sides. Here, the first clamping section protrudes beyond the gripping surface. The opposing second clamping section protrudes beyond the side of the basic body disposed opposite of the gripping surface. Here, the two clamping sections may be formed by a common component connected to the basic body. Preferably, the second clamping section protrudes further beyond the basic body than the first clamping section. The second clamping section is longer than the first clamping section. The two clamping sections are attached to the end of the basic body disposed opposite of the receptacle interface. Here, the second clamping section extends transversely from its attachment point on the end of the basic body in the direction of the receptacle interface. The second clamping section is therefore inclined in the direction of the receptacle interface from the location of its attachment to the basic body.

In one embodiment, it is contemplated that the second clamping section is designed in a wedge-shape. In this embodiment, the second clamping section has a varying cross-sectional area along its length. Here, the cross-sectional area of the second clamping section is larger in the area adjacent to the basic body than the cross-sectional area of the second clamping section on its end facing away from the basic body. Preferably, the cross-sectional area continuously decreases towards this distal end which can be realised by a wedge-shape. Such a design results in that the second clamping section is particularly resistant to bending and, at the same time, has a lower weight.

Skillfully, it is contemplated that the second clamping section comprises a second clamping surface provided for the abutment on a surface of the scaffolding element to be accommodated on its side facing away from the basic body, the second clamping surface being oriented perpendicular to the gripping surface. The second clamping section comprises a second clamping surface. This clamping surface is provided to be placed on a surface of the scaffolding element to be accommodated. Here, the second clamping surface is oriented parallel to the first clamping surface and perpendicular to the gripping surface. In the mounted state of the element receptacle in which the element receptacle is attached to an already positioned scaffolding element and inserted into the receptacle interface of a scaffolding element to be accommodated, a flow of forces through the first and the second clamping section is produced. Here, the force initially flows from the scaffolding element to be accommodated through the second clamping surface into the second clamping section. The flow of forces is guided further from the second clamping section into the first clamping section and through the first clamping surface to the already positioned scaffolding element. Of course, forces may also flow in the reverse direction. With this guidance of the flow of forces, a stable and clearance-free connection of the element receptacle both to the already positioned scaffolding element and to the scaffolding element to be accommodated is ensured.

Preferably, it is contemplated that the first clamping surface and the second clamping surface are aligned parallel to each other. With such an arrangement, a clearance-free connection of the element receptacle to the scaffolding elements connected thereto can be realised in a particularly simple manner. However, the two clamping surfaces may alternatively also be disposed at an angle with respect to each other. Here, the first and the second clamping surface may be designed to be planar be or also have a curvature or rounding. Moreover, it is possible that a coating, for example a plastic coating, is applied to the two clamping surfaces. Such a coating may improve the transmission of forces between the element receptacle and the scaffolding elements by elastically compensating potential irregularities in the surfaces and by thereby enlarging the force-transmitting surface.

Furthermore, it is advantageously contemplated that the first clamping section and the second clamping section together form the clamping region, the clamping region being implemented as a single component, preferably as a forged or bent sheet metal part, and the clamping region being connected to the basic body by a weld connection. In this embodiment, the entire clamping region is formed by a single component. This is particularly advantageous since, in this way, no connection points are required within the clamping region so that forces can be particularly well guided through the entire clamping region. Such a clamping region may be produced from a metal material, for example steel, by, for example, forging. Alternatively, the clamping region may also be formed by a bent sheet metal part. The clamping region is connected to the basic body of the receptacle by, for example, a weld connection. However, it is also possible to connect the two components to each other by means of a press connection, a screw connection, or the like. Finally, it is also possible to form the first clamping section and the second clamping section by means of two different components which are connected to the basic body each on its own.

Furthermore, it is favourably contemplated that the retainer is designed in a disc shape, and that the attaching element is disposed on the end facing away from the receptacle. In this embodiment, the retainer is implemented in a disc shape. This is to be understood to mean that the length and the width of the retainer are considerably larger than its thickness. A retainer designed in this way may, at least in sections, be cut or punched out of a steel sheet in a simple fashion. Here, the attaching element protrudes beyond a section of the retainer and is disposed on an end of the retainer facing away from the receptacle in the mounted state of the element receptacle.

In an advantageous implementation, it is contemplated that the attaching element comprises a base oriented perpendicular to an abutment surface and disposed adjacent to the abutment surface at one end, and that the attaching element further comprises a retaining area connected to the end of the base facing away from the abutment surface, a retaining surface oriented parallel to the abutment surface being disposed on the retaining area. In this embodiment, the attaching element is designed like a hook. This attaching element designed like a hook protrudes beyond the abutment surface. The attaching element is disposed at the end of the retainer facing away from the receptacle in the mounted state of the element receptacle. The attaching element comprises a base attached adjacent to the abutment surface. Here, the base extends perpendicular to the abutment surface. Adjacent to the base, a retaining area is provided which extends at a right angle to the base. Owing to this arrangement of the base and the retaining area, a hook is produced. Here, a retaining surface which is favourably designed to be planar and extends parallel to the abutment surface is provided on the inner side of the retaining area. When the element receptacle is connected to an already positioned scaffolding element the attaching element is guided by a side surface of the scaffolding element. In this connected state, the abutment surface and the retaining surface enclose two walls disposed opposingly on the scaffolding element. The surface of the base of the attaching element oriented in the direction of the receptacle abuts on another wall of the already positioned scaffolding element. By being mounted in this way, the element receptacle can first be loosely attached to the already positioned scaffolding element but will already then no longer unintentionally fall off the scaffolding element. In this way, the handling of the element receptacle, particularly the attachment of the scaffolding element to be connected is facilitated.

In one embodiment, it is contemplated that the mating joint region is implemented as a recess in the retainer, and that the joint region is implemented as a section of the basic body of the receptacle, the mating joint region implemented as a recess having a length and a width which is larger than the length and width of the joint region implemented as a section of the basic body, and the joint region being inserted into the mating joint region, the mating joint region enclosing the joint region. In this embodiment, the joint region of the receptacle is inserted into the mating joint region of the retainer. For this purpose, the mating joint region is implemented as a recess or opening in the retainer which is introduced on the side of the abutment surface facing away from the attaching element. Here, the mating joint region extends through the entire retainer. The joint region of the receptacle is formed by a section of the basic body and is dimensioned so that it is insertable into the mating joint region. During the installation of the retainer and the receptacle, the joint region of the receptacle is inserted into the mating joint region of the retainer. Then, the clamping region is connected to the basic body of the receptacle. Between the mating joint region and the joint region, there is at least a clearance fit so that both areas are movable relative to each other. Here, the mating joint region implemented as a recess has inner dimensions which are larger than the outer dimensions of the joint region. Preferably, the cross-section of the joint region, as seen in a direction from the receptacle interface to the clamping region, is designed to be rectangular and has a width and a length. Matching this, the mating joint region is implemented as a substantially rectangular recess, the length and the width of the recess being larger than the length and the width of the cross-section of the joint region. Owing to such a design, it is possible that the receptacle is rotatable relative to the retainer along a first spatial axis and linearly shiftable along a second spatial axis. Here, the mating joint region preferably encloses the joint region around its entire circumference. However, such enclosing may alternatively also only take place in a section of the circumference. The only thing to be ensured is that the receptacle is reliably guided into the retainer and not unintentionally separated from it.

In a preferred implementation, it is contemplated that the joint region implemented as a section of the basic body has a rectangular cross-section, the surface area of this cross-section being smaller than the surface area of the mating joint region. In this embodiment, the mating joint region has a rectangular cross-section which is dimensioned slightly smaller than an also rectangular cross-section of the joint region. Of course, it is also possible that the cross-section of the mating joint region and the joint region have another shape, for example a polygonal cross-section or also a cross-section having curved outer dimensions.

Furthermore, it is contemplated that the receptacle comprises at least one connecting element connected to the basic body and/or the clamping region, the connecting element being disposed on the side of the basic body disposed opposite of the gripping surface, and the connecting element comprising an aperture which is open on the side facing the basic body, the open side of the aperture at least partly bridging the joint region, and the aperture enclosing an area of the retainer disposed adjacent to the mating joint region together with the joint region. In this embodiment, the receptacle comprises a connecting element in addition to the basic body and the clamping region. This connecting element serves to secure the connection between the joint region and the mating joint region. The connecting element establishes an additional positive connection between the receptacle and the retainer which ensures that the two elements cannot be unintentionally separated from each other. For this purpose, the connecting element is disposed and attached on the side of the basic body facing away from the gripping surface. The connecting element comprises an aperture enclosing at least part of the joint region of the retainer. In this way, part of the joint region of the retainer is enclosed by the receptacle. When the element receptacle is mounted, the basic body is first separately inserted into the mating joint region implemented as a recess until the joint region is disposed in the mating joint region. Then, the connecting element is attached to the side of the basic body facing away from the gripping surface. Here, the aperture of the connecting element is positioned so that it encloses the part of the mating joint region enclosing the joint region. A connection between the connecting element and the basic body may be established, for example, by means of a weld connection.

Advantageously, it is contemplated that the connecting element is implemented in a disc shape and connected to the basic body or the clamping region on at least two surfaces disposed adjacent to the aperture, particularly by a weld connection. In a simple embodiment, the connecting element is implemented in a disc shape and has a length and a width which are significantly larger than its thickness. Such a connecting element implemented in a disc shape may be cut out of, for example, sheet metal in a simple manner. The connection of the connecting element to the basic body is established via at least two surfaces which are particularly disposed so that they are flush, parallel to each other, and located on opposite of sides of the aperture.

Optionally, it is contemplated that two connecting elements oriented parallel to each other are provided, the connecting elements being disposed on opposite sides of the receptacle interface. In this embodiment, the connection between the receptacle and the retainer is ensured by two connecting elements oriented parallel to each other. In this way, the safety of the connection is increased. Favourably, the two connecting elements are connected to the basic body so that they are disposed on opposite sides of the receptacle interface. In this way, the two connecting elements are disposed outside of the receptacle interface so that a scaffolding element to be attached can be inserted into it without an impairment by the connecting elements.

In an alternative embodiment, it is contemplated that the mating joint region is implemented in two parts, the mating joint region being formed by two recesses which are respectively produced in areas of the retainer oriented perpendicular to the abutment surface, and that the joint region is formed by two protrusions protruding from the basic body parallel to the gripping surface and to the clamping surfaces, the joint region being inserted into the mating joint region, and the mating joint region enclosing the joint region. In this alternative embodiment as well, the joint region of the receptacle is inserted into the mating joint region of the retainer. However, in this embodiment, the mating joint region is implemented in two parts and formed by two recesses in the retainer disposed opposite of each other. The areas in which the recesses forming the mating joint region are disposed are disposed in areas of the retainer which are oriented perpendicular to the abutment surface. In this alternative embodiment, the mating joint region is laterally disposed on both sides adjacent to the abutment surface in a plan view of the abutment surface. The two recesses forming the mating joint region extend through the retainer in a direction which is oriented parallel to the abutment surface. Preferably, the recesses forming the mating joint region have a rectangular cross-section. Alternatively, these recesses may also have another cross-section, for example, a circular or elliptic cross-section. In this alternative embodiment, the joint region of the receptacle is formed by two protrusions disposed on the basic body and protruding on two opposite sides in a direction parallel to the gripping surface and to the two clamping surfaces. These two protrusions preferably have a rectangular cross-section. The two protrusions may also be referred to as studs protruding beyond the remaining area of the basic body. The two protrusions forming the joint region are preferably disposed between the receptacle interface and the gripping surface on the basic body in the longitudinal direction. In the mounted state of the element receptacle, the two protrusions forming the joint region are inserted into the two recesses forming the mating joint region. As seen in a direction perpendicular to the recesses forming the mating joint region, the outer dimensions of the joint region are designed to be smaller than the inner dimensions of the recesses forming the mating joint region. Therefore, in this embodiment as well, a clearance fit between the mating joint region and the joint region is realised which renders movability of the retainer relative to the receptacle possible. In this alternative embodiment, the basic body may be implemented in one piece, and the retainer may comprise a plurality of parts which are assembled during the installation of the element receptacle. Alternatively, the retainer may also be produced in one part, and the two protrusions forming the joint region may be implemented as components other than the basic body and connected to it during the installation.

Furthermore, it is contemplated that the two recesses forming the mating joint region are disposed in respectively one limb of the retainer, the limbs being disposed on two opposite sides of the abutment surface, extending perpendicular to the abutment surface, and protruding beyond the side of the retainer disposed opposite of the attaching element. In this embodiment, the retainer comprises two limbs respectively accommodating a recess of the mating joint region. The limbs are substantially disposed at right angles to the abutment surface and extend from the lateral edges of the abutment surface in the direction opposite to the attaching element. In this way, the limbs are disposed in an area in which the already positioned scaffolding element is not accommodated so that collisions are avoided when the element receptacle is connected to the already positioned scaffolding element. Preferably, the two limbs extend beyond the abutment surface in a direction extending parallel to the abutment surface and extending from the attaching element in the direction of the receptacle. Between the two limbs and the edge of the abutment surface facing away from the attaching element, therefore, a U-shaped area is produced which is provided to enclose and to movably guide the basic body of the receptacle.

Skillfully, it is contemplated that the limbs are formed by separate components which are connected to the retainer, particularly by a weld connection. In this embodiment, the retainer is formed by a plurality of components which are connected to each other. Here, the area of the retainer on which the abutment surface is disposed as well as the two limbs are formed by different components. Optionally, the attaching element may also be formed by a separate component. In the process of mounting the element receptacle, these individual components will then be assembled, for example by weld connections. With such a multi-part design, it is achieved that the positive connection or the operative connection between the joint region and the mating joint region is established by inserting these areas into each other during the installation. After having connected the individual components, a positive connection will then be established owing to which the retainer and receptacle can no longer be separated from each other. Alternatively, the retainer or at least areas of the retainer may also be formed by a single component. The establishment of the described positive connection during the installation of the element receptacle may, in this case, be performed by bending sections of the retainer, particularly the limbs, after the two components were connected to each other.

Furthermore, it is favourably contemplated that the two recesses which form the mating joint region have a larger cross-sectional area than the two protrusions which form the joint region so that the joint region is movable within the mating joint region. With larger dimensions of the mating joint region relative to the joint region, the already described operative connection between the receptacle and the retainer is established which renders relative movements guided between the two elements possible. In the alternative embodiment in which the mating joint region is formed by two recesses, a complex cross-sectional shape of the recesses forming the mating joint region has been found to be particularly favourable. Such a complex cross-sectional shape includes at least one rectangular section directly adjoined by a triangular section. A recess having such a cross-sectional shape renders both the rotation and a relative, linear movement of a rectangularly designed joint region in such a complexly formed mating joint region possible.

Furthermore, it is contemplated that a mounting position and an operative position of the element receptacle are provided, the element receptacle being connectable to and detachable from the already positioned scaffolding element in the mounting position, and the element receptacle being fixed to the already positioned scaffolding element in the operative position. The element receptacle may assume two states or positions, a smooth transfer of the element receptacle from one position into the other position and vice versa being possible. A mounting position is provided in which the receptacle and the retainer are aligned relative to each other so that an attachment to an already positioned scaffolding element is possible. Here, the receptacle is pivoted or rotated relative to the retainer so that the already positioned scaffolding element can be placed between the retainer and the receptacle. Starting from this state, the element receptacle can then be transferred into the operative position in which the retainer and the receptacle enclose the already positioned scaffolding element. In the operative position, a scaffolding element to be attached is then insertable into the receptacle interface. In the operative position, the element receptacle at least positively encloses the already positioned element. A clamping force between the element receptacle and the already positioned scaffolding element is preferably only applied when the scaffolding element to be attached is connected to the element receptacle.

It is contemplated that, in the operative position, the abutment surface is oriented perpendicular to the gripping surface, and that the clamping surfaces are oriented parallel to the abutment surface. In the operative position, the retainer and the receptacle together enclose the already positioned scaffolding element at least to the extent that the element receptacle can no longer be separated from the already positioned scaffolding element. In the operative position, the abutment surface of the retainer is oriented perpendicular to the gripping surface of the receptacle. The two clamping surfaces are oriented parallel to the abutment surface so that a good force transmission to or towards an already positioned scaffolding element having a rectangular cross-section is possible.

Skillfully, it is contemplated that, starting from the operative position, the element receptacle is transferrable into the mounting position by a linear movement parallel to the second spatial axis and by a rotational movement about the first spatial axis of the receptacle relative to the retainer. In this embodiment, the transition from the operative position to the mounting position and vice versa is performed by two relative movements among the retainer and the receptacle. Starting from the operative position in which the element receptacle is closed, first, a linear movement of the receptacle relative to the retainer parallel to the second spatial axis which is preferably aligned perpendicular to the abutment surface is performed. With this linear movement, the first clamping surface is moved away from the abutment surface. Then, the receptacle is rotated relative to the retainer about the first spatial axis, the gripping surface being moved away from the attaching element. In this opened mounting position, the element receptacle can then be detached from the already positioned scaffolding element. Of course, the operative connection between the joint region and the mating joint region may also be implemented so that a transition between the two positions is induced by relative movements other than the ones described. For example, such a transition between the two positions may also be possible by means of a plurality of rotational movements, a plurality of linear movements, or combinations of these.

Furthermore, it is favourably contemplated that the operative connection of the joint region and the mating joint region defines the relative movement between the receptacle and the retainer and movably connects the receptacle and the retainer to each other. The connection or the operative connection of the joint region and the mating joint region forms a joint defining and guiding the relative movements among the receptacle and the retainer. This operative connection exhibits only the desired degrees of freedom required for the transfer of the element receptacle from the operative position to the mounting position and vice versa. The joint region and the mating joint region are designed so that the relative movements among the retainer and the receptacle are limited by the two components abutting on each other.

Advantageously, it is contemplated that, in the mounting position, the abutment surface assumes an angle of more than 90° relative to the gripping surface, and that the clamping surfaces are oriented at an angle other than 0° relative to the abutment surface. In the mounting position, the element receptacle is opened so that an insertion of the already positioned scaffolding element between the retainer and the receptacle is possible. To this end, the distance between the first clamping section facing upwards from the gripping surface and the lower end of the attaching element oriented in the direction of the receptacle has to be as large as possible. Therefore, the abutment surface and the gripping surface are oriented at an angle of more than 90° relative to each other in the mounting position. This position can be obtained by the receptacle being rotated relative to the retainer about the first spatial axis.

In an advantageous implementation, it is contemplated that the distance between the end of the attaching element oriented in the direction of the receptacle and the end of the first clamping region oriented in the direction of the attaching element is larger in the mounting position than in the operative position. In this embodiment as well, the element receptacle is opened further in the mounting position than in the operative position to render an insertion of the already positioned scaffolding element into the element receptacle possible.

Skillfully, it is contemplated that, in the operative position, the retaining surface of the attaching element is oriented parallel to the clamping surfaces. In this embodiment, the retaining surface disposed on the inner side of the attaching element and facing the abutment surface is oriented parallel to the two clamping surfaces in the operative position. With this parallel alignment of the surfaces, a simultaneous and uniform force transmission between the element receptacle and an already positioned scaffolding element having a rectangular cross-section is ensured. Here, the retaining surface engages on one side of the already positioned scaffolding element, and the first clamping surface engages on an opposite side of the already positioned scaffolding element.

The object of the invention is further solved by a connection system for connecting a scaffolding portion to an already positioned scaffolding portion comprising at least one element receptacle according to one of the previously described embodiments and at least one first horizontal bar forming part of the already positioned scaffolding portion, the horizontal bar comprising a support pipe which has a rectangular cross-section and is defined by two broad side surfaces and two high side surfaces in the circumferential direction, and respectively one connection interface being disposed on the front sides of the support pipe, the element receptacle being fixedly connectable to the horizontal bar in its operative position, the abutment surface abutting on one high side wall, the first clamping surface abutting on the opposite high side wall, and the gripping surface and/or the surface of the attaching element disposed opposite of the gripping surface abutting on a broad side wall.

The connection system according to the invention comprises at least one element receptacle according to one of the previously described embodiments. Moreover, the connection system comprises at least one horizontal bar which constitutes an already positioned scaffolding element. This horizontal bar is part of an already erected and positioned scaffolding portion. This already positioned scaffolding portion may comprise other scaffolding elements, for example other horizontal bars or other scaffolding elements such as, for example, vertical posts, diagonals, struts, treading coverings, or the like. The horizontal bar comprises a centrally positioned support pipe preferably having a rectangular cross-section. In the circumferential direction around the support pipe, respectively two broad side surfaces and two high side surfaces alternate. Here, the high side surfaces have a larger surface area than the broad side surfaces. On the two front ends of the support pipe disposed opposite of each other, respectively one connection interface is disposed on the horizontal bar. This connection interface serves to positively and/or non-positively connect the horizontal bar to other scaffolding elements. Such a connection interface of a horizontal bar may, for example, also be inserted into and connected to the receptacle interface of the element receptacle. In the connection system according to the invention, the element receptacle may be fixedly connected to the horizontal bar in its operative position. In the connected state of the element receptacle and the horizontal bar, the abutment surface of the retainer abuts on a high side wall of the support pipe. The first clamping surface of the receptacle abuts on the second high side wall of the support pipe on the opposite side. Moreover, the gripping surface of the receptacle and/or the surface of the attaching element of the retainer disposed opposite of the gripping surface abuts on a broad side wall. Here, either only one of these surfaces may abut on a broad side wall, or both surfaces may respectively abut on opposing broad side walls. The connection system according to the invention has a simple design and is easy to handle. The attachment of the element receptacle to the horizontal bar constituting an already positioned scaffolding element can be performed without the aid of tools. Owing to the simple design of the element receptacle, it can be connected to the horizontal bar with one hand. This connection is performed in the mounting position of the element receptacle. After this connection, the element receptacle can be transferred into the operative position in which the element receptacle and the horizontal bar are then fixedly connected to each other by simple movements. In the operative position of the element receptacle, the entire connection system according to the invention is connected to each other in a clearance-free manner and renders a secure force transmission and a stable attachment of other scaffolding elements or another scaffolding portion to the element receptacle possible. A further advantage of the connection system according to the invention is that it comprises a horizontal bar which is already known. For providing a connection system according to the invention, therefore, only an element receptacle according to the invention has to be acquired. The element receptacle can be combined with already existing horizontal bars which are elements of an already existing scaffolding or scaffolding portion to form a connection system according to the invention in a simple manner.

In one embodiment of the connection system, it is contemplated that the abutment surface, the gripping surface, the attaching element, and the first clamping region form an undercut positively enclosing the support pipe in its cross-section in the operative position. The mentioned elements or components of the element receptacle are shaped and disposed relative to each other so that they enclose the support pipe to the extent that the element receptacle and the support pipe can no longer be separated from each other in the operative position. This is achieved by the indicated elements or components together forming an undercut from which the support pipe cannot be removed. During a transition into the mounting position, this undercut is reduced or removed so that the support pipe can be taken out of the element receptacle, or the element receptacle can be detached from the support pipe.

Furthermore, it is contemplated that the second clamping region protrudes beyond the broad side wall facing away from the attaching element in the operative position. It is contemplated that the second clamping region protrudes beyond the support pipe in a direction parallel to the high side walls of the support pipe. The second clamping region therefore protrudes beyond the broad side wall which is in contact with the gripping surface of the receptacle. A second clamping region protruding in this way is required for establishing a contact and for transmitting forces to the scaffolding element to be attached. The second clamping surface disposed on the second clamping region is provided to be brought into contact with a scaffolding element to be attached and to transmit forces to it.

Skillfully, it is contemplated that a second horizontal bar is provided which is part of the scaffolding portion connected or to be connected, a connection interface of the horizontal bar being inserted into the receptacle interface of the element receptacle. In this embodiment, a second horizontal bar is part of the connection system and constitutes a scaffolding element to be attached which is part of a scaffolding portion to be attached or to be connected. The design of the second horizontal bar is analogous to the first horizontal bar, may, however, be different from the first horizontal bar in its dimensions. The connection interface of the second horizontal bar is inserted into the receptacle interface of the element receptacle. With this penetration, the first horizontal bar, the element receptacle, and the second horizontal bar are then fixedly connected to each other without a clearance.

Advantageously, it is contemplated that, in the operative position, respectively one surface of the connection interface of the second horizontal bar abuts on the second clamping surface and the surface of the retainer disposed opposite of the abutment surface. The fixation of the connection system is at least partly performed by one surface of the connection interface of the second horizontal bar exerting pressure on the second clamping surface of the element receptacle. Another surface of this connection interface exerts pressure on the surface of the retainer disposed on the side disposed opposite of the abutment surface. Therefore, the connection interface of the second horizontal bar exerts pressure on both a surface of the retainer and on a surface of the receptacle of the element receptacle. Owing to this constellation, the first horizontal bar, the element receptacle, and the second horizontal bar are non-positively clamped to each other so that a clearance-free connection is established.

In an advantageous implementation, it is contemplated that, in the operative position, one surface of the connection interface of the second horizontal bar abuts on a surface of the receptacle interface facing away from the clamping region. It is contemplated that another surface of the connection interface of the second horizontal bar abuts on the inner side of a surface the of receptacle interface. Here, this other surface of the connection interface abuts on the inner side of the receptacle interface disposed on the side of the receptacle interface disposed opposite of the clamping region. As seen in the longitudinal direction of the support pipe, the other surface of the connection interface is disposed on the side of the connection interface disposed opposite of the side on which the two surfaces abutting on the second clamping surface and on the abutment surface are disposed here. Here, the two surfaces abutting on the second clamping surface and the abutment surface are facing away from support pipe while, in contrast, the surface of the connection interface abutting on the inner side of the connection interface faces the support pipe. Owing to the abutment of the surface of the connection interface on the inner side of the receptacle interface, the receptacle is drawn towards the second horizontal bar. In this way, the receptacle moves relative to the retainer so that in turn the first horizontal bar is clamped between the retainer and the receptacle. Therefore, a non-positive fixation of the connection system is established by the insertion of the connection interface of a second horizontal bar into the receptacle interface. In this way, the connection system is quasi automatically fixed by the insertion of a second horizontal bar to be connected. This structure is self-assisting so that errors during the assembly of the connection system or during the attachment of another scaffolding element to a scaffolding portion can be prevented. As soon as the second horizontal bar which is connected to the connection interface is strained the non-positive connection between the components is even reinforced.

Skillfully, it is contemplated that, during the insertion of the connection interface of the second horizontal bar into the receptacle interface of the element receptacle, the connection interface of the receptacle interface is moved away from the retainer along the second spatial axis and thereby clamps the support pipe between the first clamping surface and the abutment surface in a direction parallel to the broad side wall. With the insertion of the connection interface of the second horizontal bar into the receptacle interface, a surface of the connection interface is brought into contact with a surface the of the receptacle interface facing inwards as described above. Owing to this contact between the two surfaces, the connection interface draws the receptacle interface and therefore the receptacle along the second spatial axis away from the retainer. In this way, the first clamping surface of the clamping region is moved towards the retainer and the abutment surface. Owing to this movement, the distance between the first clamping surface and the abutment surface is decreased so that the support pipe of the first horizontal bar is clamped between these two surfaces. The establishment of a non-positive fixation is therefore automatically achieved in a simple manner when the connection interface of the second horizontal bar is inserted into the receptacle interface.

Skillfully, it is contemplated that, in the operative position, a non-positive connection exists between the first horizontal bar and the element receptacle as well as between the second horizontal bar and the element receptacle so that these three components are connected to each other without a clearance. In the operative position of the element receptacle, there is both a positive and a non-positive connection between all components or elements of the connection system. This connection is therefore extremely stable and reliable.

The object of the invention is further solved by a method for mounting a scaffolding portion on an already positioned scaffolding portion using at least one element receptacle according to one of the previously described embodiments, comprising the steps of:

A) transferring the element receptacle into the mounting position,

B) positioning the element receptacle on a horizontal bar of the already positioned scaffolding portion so that the attaching element encloses a first broad side wall of the horizontal bar in combination with the abutment surface, C) guiding the first clamping section past the second broad side wall disposed opposite of the first broad side wall so that the gripping surface encloses the second broad side wall in combination with the first clamping region, D) rotating the receptacle relative to the retainer about the joint formed of the joint region and the mating joint region about the first spatial axis until the gripping surface abuts on the second broad side wall of the horizontal bar disposed opposite of the attaching element, E) inserting a connection interface of a horizontal bar which is part of the scaffolding portion to be attached into the receptacle interface of the element receptacle, F) linearly moving the connection interface parallel to the receiving surface in the direction from the attaching element to the clamping region, the receptacle, guided by the joint formed by the joint region and the mating joint region, being linearly moved away from the retainer along the second spatial axis by the contact of the connection interface to the receptacle interface until the horizontal bar is non-positively clamped between the first clamping surface and the abutment surface and the operative position reached is thereby.

The method serves the attachment of a scaffolding element to be attached or of scaffolding portion a to be attached to an already positioned scaffolding element or an already positioned scaffolding portion. In the method, an element receptacle according to one of the previously described embodiments is used. Therefore, also the use of an element receptacle according to one of the previously described embodiments for mounting a scaffolding portion or scaffolding element to an already positioned scaffolding portion or scaffolding element is disclosed. The disclosed method is preferably carried out in the described order of the process steps A) to F). However, it is also feasible to change the order of the process steps.

Prior to the start of the method, a scaffolding element which is part of a scaffolding portion has already been erected and positioned. This scaffolding element is preferably formed by an already positioned first horizontal bar which is the starting point of the process steps described in the following.

In a first process step A), the element receptacle is transferred into the mounting position to which end the receptacle and the retainer are correspondingly moved relative to each other.

In a second process step B), the element receptacle is positioned on the first horizontal bar of the already positioned scaffolding portion. Here, positioning is to be understood to mean that the element receptacle is first positively connected to the horizontal bar with a clearance. Here, the attaching element is mounted on the horizontal bar so that it encloses a broad side wall facing upwards.

In a third process step C), the first clamping section is then guided past the second broad side wall of the horizontal support disposed opposite of the broad side wall enclosed by the attaching element. This passage is performed by a rotational movement of the element receptacle relative to the horizontal bar.

In a fourth process step D), the receptacle is rotated relative to the retainer until the gripping surface of the receptacle an abuts on the broad side wall facing away from the attaching element.

In this state, the abutment surface abuts on a high side wall of the horizontal bar or is at least disposed at a small distance to this high side wall. During the rotation, the mating joint region and the mating joint region interact and form a joint guiding and determining the rotation about the first spatial axis.

In a fifth process step E), a connection interface of a second horizontal bar is inserted into the receptacle interface of the pivoted and rotated element receptacle. The second horizontal bar is a scaffolding element to be attached which may be part of a scaffolding portion to be attached. Typically, the connection interface is inserted into the receptacle interface by a linear downwards movement in the vertical direction.

In a sixth process step F), the connection interface of the second horizontal bar is moved relative to the element receptacle parallel to the receiving surface from the attaching element in the direction of the clamping region. With this linear movement, the connection interface is inserted further into the receptacle interface. During this insertion, a surface of the connection interface abuts on the inner side of a surface of the receptacle interface. The receptacle interface and therefore the receptacle is linearly moved relative to the retainer along the first spatial axis by this contact. Here, the receptacle interface is drawn away from the retainer. This linear movement is also guided by the joint formed by the joint region and the mating joint region. With the relative movement of the receptacle towards the retainer, the first clamping region including the first clamping surface disposed thereon also moves relative to the retainer, the first clamping surface moving towards the abutment surface. However, the second horizontal bar which is finally clamped by the relative movement of the two surfaces relative to each other is disposed between the first clamping surface and the abutment surface. A non-positive connection between the two horizontal bars and the element receptacle is established by this clamping. At the end of the linear movement of the second horizontal bar relative to the element receptacle, the operative position of the element receptacle is reached, and the components are fixedly and securely connected to each other.

The disclosed method can be carried out in a simple manner. At least for process steps A) to E), no tool is required. For process step F), optionally, a hammer or rubber mallet can be deployed which is used to strike the connection interface of the second horizontal bar for implementing the linear movement. Due to the movable design of the element receptacle which can be transferred into the mounting position from the operative position and vice versa in a simple manner, the element receptacle is rapidly and securely connectable to the already positioned first horizontal bar. The transition of the receptacle interface or of the connection system into the operative position is quasi automatically performed by connecting the second horizontal bar. Therefore, the disclosed method is little susceptible to errors and can be safely performed even by persons without a professional training.

In one embodiment of the method, it is contemplated that process step E) is already performed prior to or during process step D). In this embodiment, the order of process steps D) and E) is reversed, or both process steps are carried out simultaneously. Both process steps serve to transfer the element receptacle into the operative position from the mounting position. During the insertion of the connection interface of a second horizontal bar according to process step E), the receptacle may be simultaneously rotated relative to the retainer according to process step D). By simultaneously performing the two process steps, time for carrying out the method can be saved.

Furthermore, it is contemplated that, during process step F), the second clamping surface contacts the connection interface and is pressed against the connection interface when the operative position is reached. Towards the end of the linear movement of the connection interface of the second horizontal bar into the receptacle, the second clamping surface disposed on the lower end of the second clamping region contacts the part the connection interface which was already guided through the receptacle interface. In this state, this surface of the connection interface exerts pressure on the second clamping surface so that forces are transferred among the two surfaces. In addition to the flow of forces already rendered possible by the contact of another area of the connection interface to the retainer, the contact between the second clamping surface and the connection interface renders a flow of forces through these two surfaces possible. Owing to these two paths through which a flow of forces can be guided, a clamped, particularly a stable non-positive connection of the components is established.

Skillfully, it is contemplated that, during process step F), an operating element of the connection interface is operated so that the shape of the connection interface, particularly a circumference of the connection interface, is changed and/or enlarged. In this embodiment, the connection interface of the second horizontal bar has a multi-part design and comprises an operating element. When this operating element operated, the outer circumference of the connection interface is enlarged, the shape of the cross-sectional area of the connection interface being changed. In the method, the connection interface is inserted into the receptacle interface, and then the operating element is operated. Due to an enlargement of the outer circumference or the outer dimensions of the connection interface resulting therefrom, a surface of the connection interface is pressed against a surface the of receptacle interface so that the already described linear movement of the receptacle relative to the retainer parallel to the second spatial axis takes place. The operation of the operating element therefore results in a relative movement of the receptacle and the retainer and transfers the element receptacle into the operative position.

Skillfully, it is contemplated that, after the operative position is reached, additional scaffolding elements of the scaffolding portion to be connected are connected to the second horizontal bar. After having carried out the method, other scaffolding elements can be connected to the already connected second horizontal bar. This connection of the other scaffolding elements may be implemented by either an element receptacle or also by other types of connection.

Advantageously, it is contemplated that the method is repeated once or several times for the same, already positioned scaffolding portion. A plurality of scaffolding elements to be attached can be connected to an already positioned scaffolding portion by carrying out the method multiple times. In this way it is possible to, for example, connect a panel to an already positioned horizontal bar in a simple manner.

The features, effects, and advantages described in connection with the element receptacle may analogously also be applied to the connection system, the method, and the use of the element receptacle and are therefore also deemed disclosed. The same applies in the reverse direction: the features, effects, and advantages described in connection with the method, the use, or the connection system may also be applied to the element receptacle and are also deemed disclosed.

Figure 2:
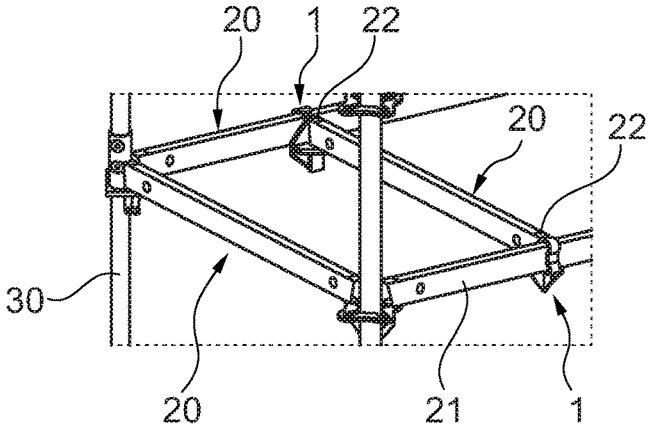
Figure 3:
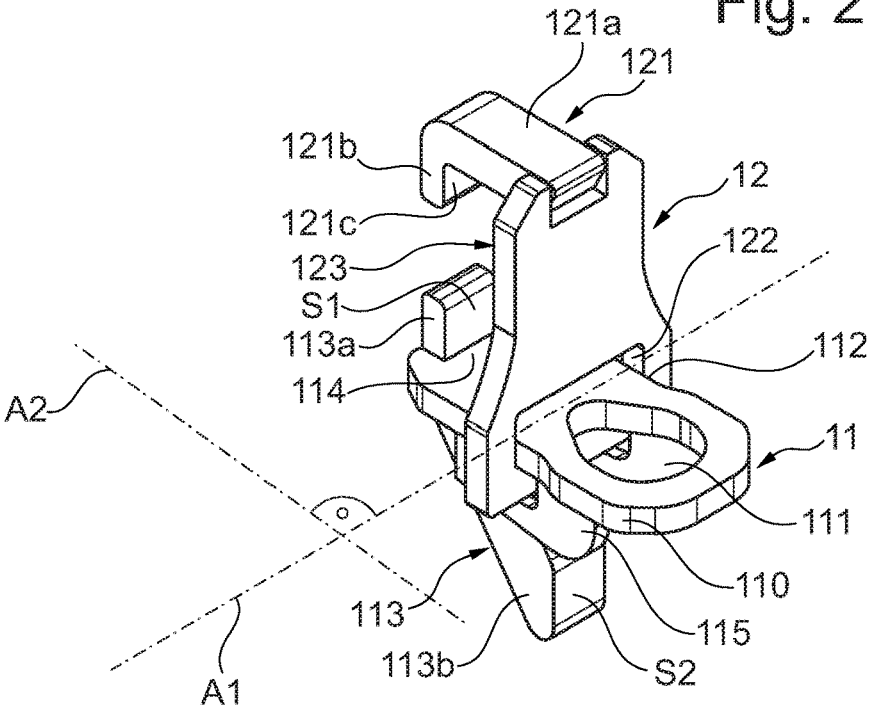
Figure 4:
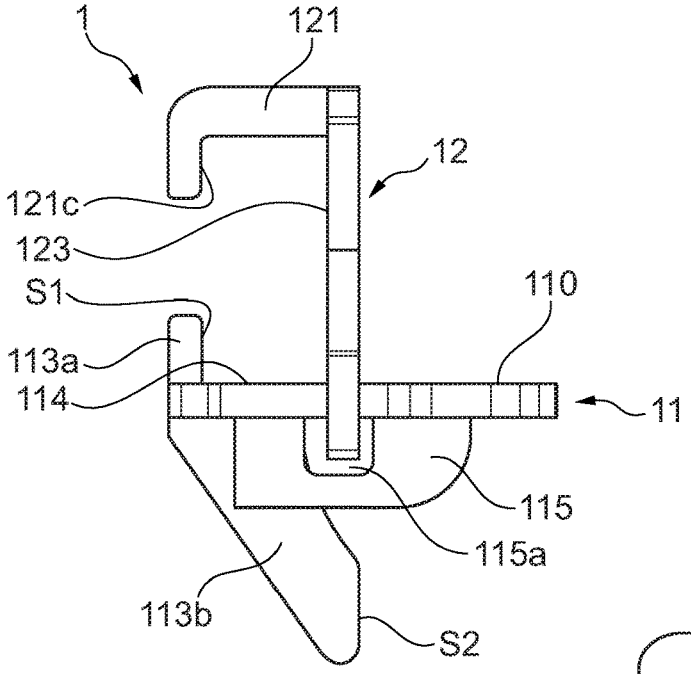
Figure 5:
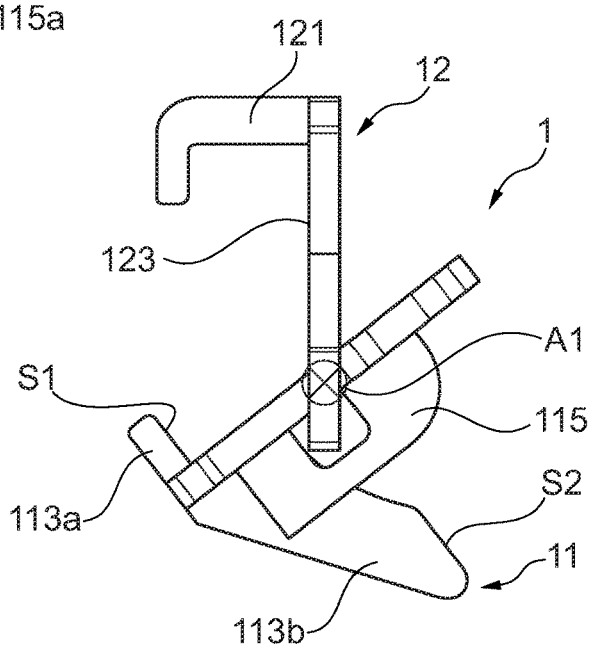
Figure 6:
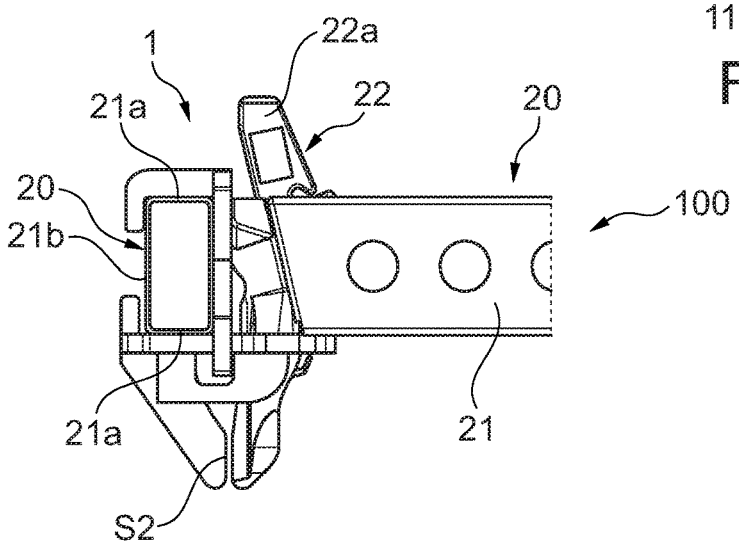
Figure 7:
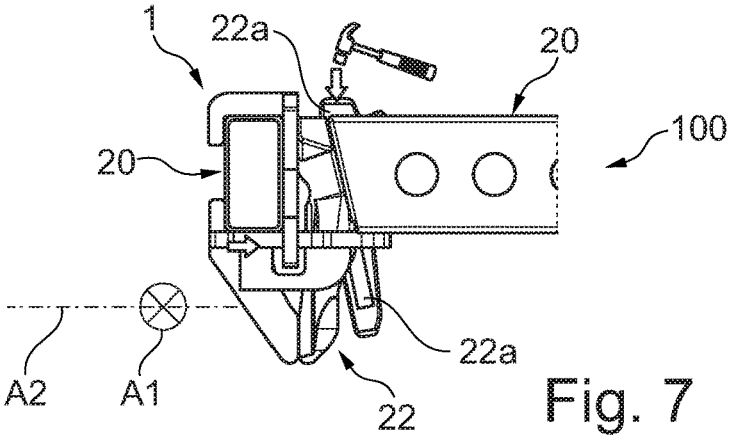
Figure 8:
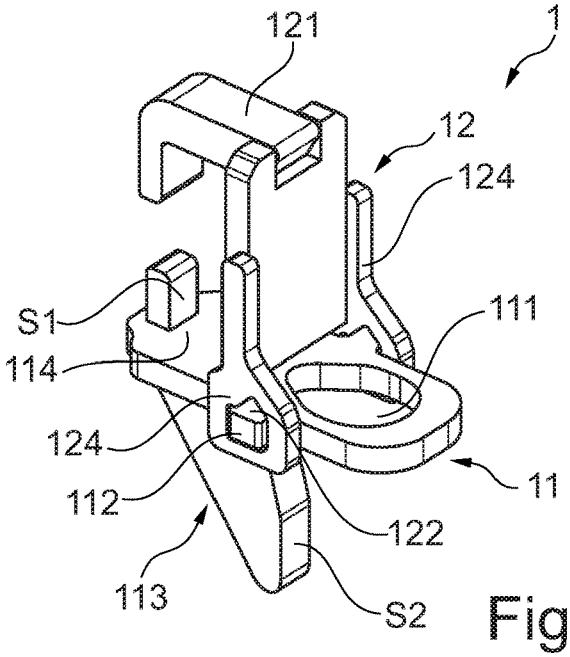
Figure 9:
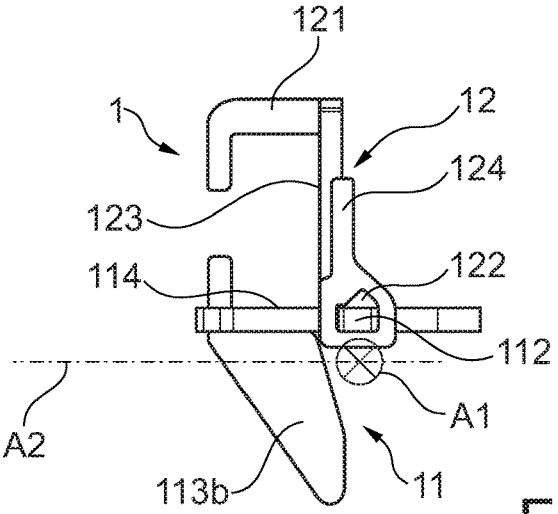
Figure 10:
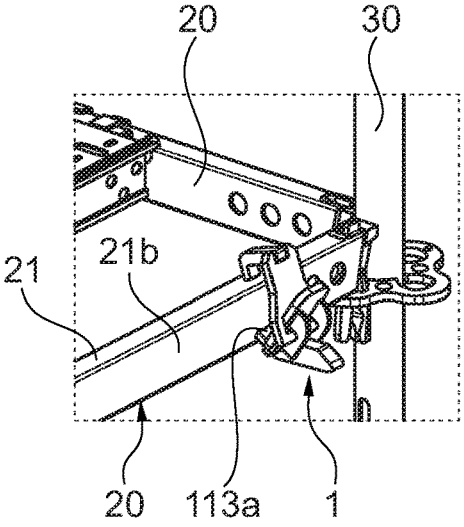
Figure 11:
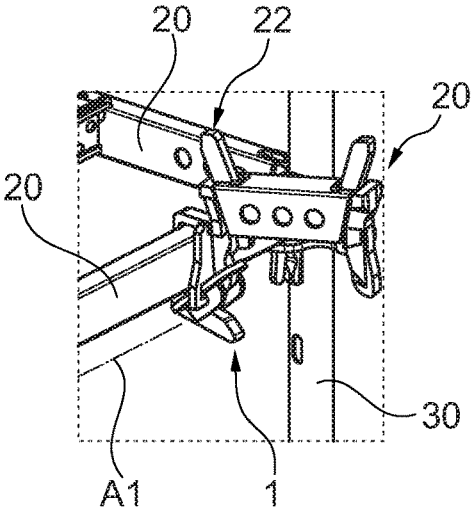
Figure 12:
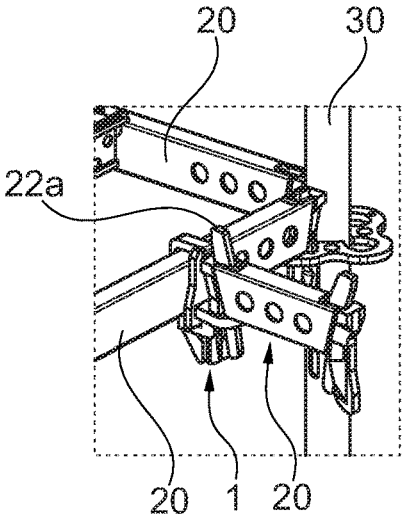
Figure 13:
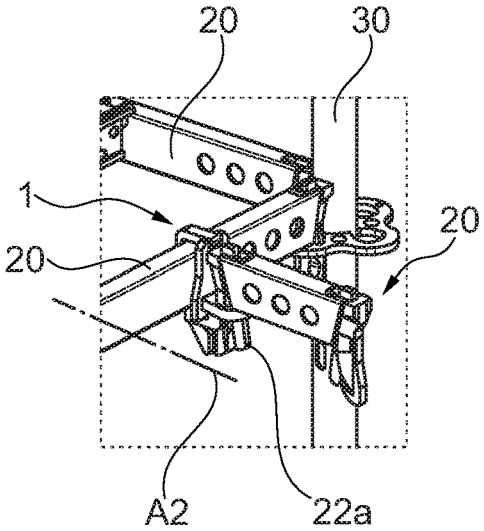

In the Figures, embodiments of the invention are schematically illustrated. Here:

FIG. 1 shows a perspective view of a scaffolding portion including a horizontal bar fastened by two element receptacles, FIG. 2 shows a perspective, enlarged view of a section of the scaffolding portion of FIG. 1, FIG. 3 shows a perspective view of a first embodiment of an element receptacle according to the invention, FIG. 4 shows a side view of the first embodiment of an element receptacle in the operative position, FIG. 5 shows a side view of the first embodiment of an element receptacle in the mounting position, FIG. 6 shows a side view of a first embodiment of a connection system according to the invention in-between the mounting position and the operative position, FIG. 7 shows a side view of the first embodiment of a connection system according to the invention in the operative position, FIG. 8 shows a perspective view of a second embodiment of an element receptacle according to the invention, FIG. 9 shows a side view of the second embodiment of an element receptacle in the operative position, FIG. 10 shows a perspective view of a first state during the attachment of an embodiment of a connection system to an already positioned scaffolding portion, FIG. 11 shows a perspective view of a second state during the attachment of an embodiment of a connection system to an already positioned scaffolding portion, FIG. 12 shows a perspective view of a third state during the attachment of an embodiment of a connection system to an already positioned scaffolding portion, and FIG. 13 shows a perspective view of a fourth state during the attachment of an embodiment of a connection system to an already positioned scaffolding portion.

In the Figures, identical elements are designated by the same reference numerals. Basically, the described features of an element described in connection with one Figure also apply to the other Figures Directional information such as upper or lower refer to the described Figure and should be applied to other Figures according to their meaning.

FIG. 1 shows a perspective view of a scaffolding portion including a horizontal bar 20 fastened by two element receptacles 1. In FIG. 1, a scaffolding portion comprising four vertically oriented vertical posts 30 can be seen. The four vertical posts 30 are connected to two horizontally oriented frames disposed one above the other. The frames are respectively formed by four horizontal bars 20. Each of these frames constitutes a horizontal level in the scaffolding portion. Of course, the scaffolding portion can be expanded and comprise further scaffolding elements. In the upper frame, an additional horizontal bar 20 is disposed which is located within the frame. Such an additional horizontal bar 20 may be required, for example, to provide for an opening in the horizontal level through which persons working on the scaffolding portion can climb. The opening between the frame and the additionally attached horizontal bar 20 disposed on the front left in FIG. 1 may be used, for example, as an opening for such a passage. The area of the frame extending from the additionally attached horizontal bar 20 to the rear right may then be provided with a treading covering and closed thereby. The horizontal bar 20 illustrated in FIG. 1 which is additionally disposed in the frame is an example of an application in which a frame formed of four horizontal bars 20 is to be expanded by another horizontal bar 20. However, there are also other applications requiring the attachment of another horizontal bar 20. For example, a panel also supported by one or a plurality of additional horizontal bars 20 may be required outside of the frame. In this case, the additional horizontal bar 20 is attached so that it is positioned outside of the frame and extends outwards from there. The horizontal bars 20 forming the frame usually do not include interfaces for the direct attachment of other horizontal bars 20. For this reason, element receptacles 1 exist which render such a connection of two horizontal bars 20 possible. In the state illustrated in FIG. 1, the additional horizontal bar 20 disposed within the frame is connected to respectively one of the longer horizontal bars 20 forming the frame by two such element receptacles 1.

FIG. 2 shows a perspective, enlarged view of a section of the scaffolding portion of FIG. 1. In FIG. 2, the area of the upper frame of the scaffolding portion of FIG. 1 facing the front left is shown in an enlarged view. In FIG. 2, the two element receptacles 1 rendering the connection of the additional horizontal bar 20 to the already positioned, longer horizontal bars 20 of the frame possible can be clearly seen. The element receptacles 1 are, on the one hand, connected to respectively one support pipe 21 of one of the horizontal bars 20 belonging to the frame and, on the other hand, to a connection interface 22 of the additional horizontal bar 20 disposed within the frame. The position of the element receptacle 1 relative to the already positioned horizontal bars forming the frame is freely adjustable. Therefore, it is possible to also position the additional horizontal bar 20 in another position in the frame in a simple manner. In the state shown in FIGS. 1 and 2, the element receptacle 1 is in the operative position. In this operative position, the element receptacle 1 establishes a fixed, clearance-free connection of the horizontal bars 20. For the installation and deinstallation of the scaffolding portion or of the connection system formed by an element receptacle 1 and two horizontal bars 20, the element receptacle 1 can be transferred into the mounting position.

FIG. 3 shows a perspective view of a first embodiment of an element receptacle 1 according to the invention. The element receptacle 1 comprises two assemblies: on the upper side in the illustration, there is the retainer 12. The retainer 12 is movably connected to the receptacle 11. In the illustrated embodiment, the retainer 12 is implemented in a plate or disc shape. Its length oriented upwards in the illustration and its width extending from the front left to the rear right in the illustration are significantly larger than its thickness. On the end of the retainer 12 facing upwards, an attaching element 121 is disposed which has the shape of a hook here. The attaching element 121 faces away from the viewer in the illustration. On the side facing away from the viewer, the abutment surface 123 is disposed below the attaching element 121. This abutment surface 123 is designed to be planar and provided to be brought into contact with a high side wall 21*b* of a support pipe 21 of an already positioned horizontal bar 20. The abutment surface 123 extends from the attaching element 121 up to the mating joint region 122. The mating joint region 122 forms a joint guiding and defining the relative movement among receptacle 11 and retainer 12 together with the joint region 112 of the receptacle 11. In the illustrated first embodiment, the mating joint region 122 is implemented as a recess extending through the retainer 12. The recess forming the mating joint region 122 is disposed on the side of the abutment surface 123 disposed opposite of the attaching element 121. In the illustrated embodiment, the retainer 12 is formed of two components. In a first component, the mating joint region 122 is disposed, and the abutment surface 123 is provided as a planar surface. The hook-shaped attaching element 121 is formed by a second component. However, the two components were fixedly connected to each other, for example, through a weld connection after their moulding and production. In this way, the retainer 12 is easy to produce at low costs. In the illustrated embodiment, the component of the retainer 12 in which the mating joint region 122 is disposed is designed in a bell shape in a plan view of the abutment surface 123. In this way, a high stiffness is achieved at an, at the same time, low weight. Alternatively, this first component of the retainer 12 may also have a simple rectangular shape or another shape. Likewise, it is possible that the entire retainer 12 is formed by a single component. The attaching element 121 protruding beyond the abutment surface 123 may, in this case, be produced by reshaping, for example, by bending a section of the retainer 12. In the illustrated embodiment, the recess forming the mating joint region 122 is designed to be rectangular. However, the shape of this recess may also have another design.

In the illustrated embodiment, the receptacle 11 comprises two components: the basic body 110 in which the receptacle interface 111 is disposed as a recess is oriented towards the front right. The joint region 112 is disposed laterally on the basic body 110. The second component of the receptacle 11 is formed by the clamping region 113 which is fixedly connected to the basic body 110. The clamping region 113 comprises a first clamping section 113*a* oriented upwards in the illustration which is oriented in the direction of the attaching element 112 from the basic body 110. The clamping region 113 further comprises a second clamping section 113*b* oriented downwards in the illustration which is oriented in the direction of the side facing away from the attaching element 121 from the basic body 110. The second clamping section 113*b* has a larger length than the first clamping section 113*a*. In the illustrated embodiment, the first clamping section 113*a* and the second clamping section 113*b* are formed by a common component also forming the clamping region 113. In the illustrated embodiment, the joint region 112 is formed as a section of the basic body 110. This section forming the joint region 112 has a rectangular cross-section in a plane parallel to the abutment surface 123. Here, the outer dimensions of the rectangular cross-section of the joint region 112 are designed to be smaller than the inner dimensions of the recess forming the mating joint region 122. In the illustrated first embodiment, the joint region 112 is inserted into the mating joint region 122 and forms a joint or an operative connection between the receptacle 11 and the retainer 12 together with it. The joint region 112 comprises two surfaces which are parallel to each other, planar, and facing away from the basic body 160 which contact two likewise planar, parallel inner surfaces of the mating joint region 122 or are disposed at a small distance to these. A first spatial axis A1 extends perpendicular to these two parallel, planar surfaces of the joint region 112. At the same time, the first spatial axis A1 extends parallel to the abutment surface 123 and to the clamping surfaces S1 and S2. A second spatial axis A2 is shown perpendicular to the first spatial axis A1. Both spatial axes A1 and A2 are imaginary axes facilitating the description of the relative movement or movability of the retainer 12 and the receptacle 11. In addition, the second spatial axis A2 extends parallel to the gripping surface 114 of the receptacle 11. In the illustrated first embodiment, a connecting element 115 which is connected to the basic body 110 through two surfaces here is disposed below the basic body 110. The connecting element 115 is attached on the side of the basic body 110 disposed opposite of the gripping surface 14. The connecting element 115 serves to ensure that retainer 12 and receptacle 11 are positively but movably connected to each other but cannot separated from each other. The connecting element 115 comprises an aperture 115*a* enclosing a section of the retainer 12 disposed below the mating joint region 112. In this embodiment, the connecting element 115 is a part which belongs to the receptacle 11. In the present embodiment, the connecting element 115 is connected to the basic body 110 by a weld connection. The receptacle interface 111 is configured as an opening or recess in the receptacle 11. In a plan view of the gripping surface 114, the receptacle interface 111 has a substantially oval shape. In this view, the shape of the receptacle interface 111 is selected so that it is designed so that it is complementary to the type of connection interface 22 which is provided on a horizontal bar 20 to be attached. This means that the shape of the receptacle interface 111 may also have a design other than the shown shape in case of another shape of the connection interface 22 of the horizontal bar 20. The clamping region 113 is disposed on the side of the gripping surface 114 disposed opposite of the receptacle interface 111. On the first clamping region 113*a* protruding upwards beyond the gripping surface 114 in the view, the first clamping surface S1 is disposed which has a planar design and is oriented parallel to the abutment surface 123 in the shown position of the element receptacle 1. The first clamping surface S1 is also disposed parallel to the retaining surface 121*c* of the attaching element 121 also having a planar design. The attaching element 121 consists of a base 121*a* oriented perpendicular to the abutment surface 123 and disposed adjacent to the abutment surface 123 at one of its ends. The retaining area 121*b* which is attached to the end of the base 121*a* disposed opposite of the abutment surface at one of its ends is also disposed perpendicular to the base 121*a*. The base 121*a* and the retaining area 121*b* together produce a hook shape of the attaching element 121. The retaining surface 121*c* is disposed inside the attaching element 121 and oriented parallel to the abutment surface 123. The clamping region 113 comprises a second clamping section 113*b* which is oriented downwards in the illustration and on which the second clamping surface S2 is disposed. The second clamping surface S2 is oriented parallel to the first clamping surface S1. The second clamping section 113*b* is disposed on the side of the basic body 110 disposed opposite of the gripping surface 114 and oriented in the direction opposite to the retainer 12.

The joint region 112 and the mating joint region 122 together form a joint or an operative connection which guides the retainer 12 relative to the receptacle 11. In the illustrated embodiment, the mating joint region 122 is formed by a substantially rectangular recess in the retainer 12. The joint region 112 is formed by a section of the basic body 110 which also has a substantially rectangular cross-section. The outer dimensions of the joint region 112 are the inner dimensions of the mating joint region 122. In this way, the receptacle can be rotated relative to the retainer 12 about the first spatial axis A1, this rotational movement being guided by the joint formed by the mating joint region 122 and the joint region 112. In addition, the receptacle 11 can be linearly shifted relative to the retainer 12 along or parallel to the second spatial axis A2. In this way, the receptacle interface 111 can be moved towards and away from the retainer 12. With a rotation about the first spatial axis A1 and a shift along the second spatial axis A2, the element receptacle 1 which is in the operative position in FIG. 1 can be transferred into the mounting position. The operative position and the mounting position are illustrated in FIG. 4 and FIG. 5. In the first embodiment of the element receptacle 1, all of its components are made of the same basic material, for example of steel. Alternatively, other materials can be used, for example plastic materials to the extent they exhibit the required mechanical load capacity.

FIG. 4 shows a side view of the first embodiment of an element receptacle 1 in the operative position. In FIG. 4, the first embodiment of an element receptacle 1 also illustrated in FIG. 3 can be seen in a side view. The retainer 12 on the upper end of which the hook-shaped attaching element 121 which is oriented towards the right here is disposed is oriented upwards. The abutment surface 123 disposed on the retainer and oriented vertically in the illustration is also facing leftwards in the illustration. The receptacle 11 which is oriented horizontally in the illustration is inserted into the retainer 12. Here, the planar gripping surface 114 is directed upwards in the illustration. In FIG. 4, the operative position of the element receptacle 1 is illustrated in which it can be fixedly connected to an already positioned scaffolding element, for example a horizontal bar 20. A connection system 100 in a corresponding operative position including the illustrated, already positioned horizontal bar 20 can be seen in FIG. 7. In the operative position, the attaching element 121, the abutment surface 123, the gripping surface 114, and the clamping surface S1 together form an undercut into which a scaffolding element to be positioned can be inserted. A scaffolding element inserted into this undercut is then enclosed by the element receptacle 1 so that the element receptacle can no longer be separated from the already positioned scaffolding element. In the illustrated operative position, the abutment surface 123 is oriented substantially perpendicular to the gripping surface 114. The two clamping surfaces S1 and S2, on the other hand, are oriented substantially parallel to the abutment surface 123 as well as to the retaining surface 121*c* on the attaching element 121. The area of the basic body 110 facing rightwards from the retainer 12 in the illustration is also oriented substantially perpendicular to the abutment surface 123. In FIG. 4, the connecting element 115 serving the additional connection of the receptacle 11 and the retainer 12 can be clearly seen. An aperture 115*a* is disposed approximately in the centre of the connecting element 115. In the illustrated, connected state, the end portion of the retainer 12 facing away from the attaching element 121 is inserted into the aperture 115*a* of the connecting element 115 and partly enclosed by it. This area of the retainer 12 disposed below the mating joint region 112 is therefore enclosed by the combination of the connecting element 115 and the basic body 110 around its entire circumference. Therefore, the receptacle 11 cannot be separated from the retainer 12 even though the two components are connected to each other so that they are movable relative to each other. During the assembly of the element receptacle 1, the basic body 110 is first inserted into the mating joint region 122 so that the joint region 112 is disposed inside the mating joint region 122. Then, the aperture 115*a* the of connecting element 115 is pushed over the part of the retainer 12 facing downwards and connected to the surface of the basic body 110 facing downwards by weld connections via two surfaces. In the illustrated side view, the aperture 115*a* has a substantially rectangular shape. However, the aperture 115*a* may also have another shape, for example the shape of a semicircle, or another shape. In the side view in FIG. 4, the shape of the second clamping section 113*b* oriented downwards can be clearly seen. In the area in which the second clamping section 113*b* adjoins the basic body 110, it has a wedge-shaped design and is tapered with an increasing distance to the basic body 110. In this way, the second clamping section 113*b* is, on the one hand, designed so that it is resistant to bending about a bending axis parallel to the first spatial axis A1 and, on the other hand, configured so that it is compact and light-weight. On the lower end of the second clamping section 113*b*, the planar second clamping surface S2 provided for the transmission of forces to the connection interface 22 of a horizontal bar 20 is disposed so that it faces rightwards. In the state connected to the connection interface 22, a force which is transferred on by the second clamping section 113*b* and guided to the basic body 110 and the first clamping section 113*a* is introduced into the second clamping section 113*b* via the second clamping surface S2. During this transmission of the force, the second clamping section 113*b* is subjected to bending. For this reason, the second clamping section 113*b* has the described wedge-shape.

FIG. 5 shows a side view of the first embodiment of an element receptacle 1 in the mounting position. FIG. 5 shows the same embodiment of an element receptacle 1 as FIG. 4. In FIG. 5, the element receptacle 1 was transferred into the mounting position starting from the operative position illustrated in FIG. 4. To this end, the receptacle 11 was rotated counterclockwise relative to the retainer 12 about the first spatial axis A1. Here, the first spatial axis A1 extends into the plane of the drawing. The rotation about the first spatial axis A1 is guided by the joint formed by the interaction of the joint region 112 and the mating joint region 122. In the illustrated mounting position, the element receptacle 1 can be connected to an already positioned scaffolding element, particularly an already positioned horizontal bar 20, in a simple manner. The undercut described in connection with FIG. 4 which is formed by a plurality of components of the element receptacle 1 in the operative position is eliminated in the illustrated mounting position. Therefore, a horizontal bar can be inserted into or taken out of the element receptacle 1. In the mounting position, the distance between the end of the attaching element 121 facing downwards in the illustration and directed in the direction of the receptacle 11 and the end of the first clamping region 113*a* facing upwards in the illustration is larger than the corresponding distance in the operative position illustrated in FIG. 4. Owing to this larger distance in the mounting position, the element receptacle 1 can be separated from or connected to the already positioned scaffolding element. In the mounting position, the angle between the gripping surface 114 and the abutment surface 123 is larger than 90°. In the mounting position, the two clamping surfaces S1 and S2 are no longer aligned parallel to the abutment surface 123 and to the retaining surface 121*c*. In the mounting position, the connecting element 115 also ensures that the receptacle 11 and the retainer 12 cannot be separated from each other.

FIG. 6 shows a side view of a first embodiment of a connection system 100 according to the invention in-between the mounting position and the operative position. Here, the illustrated connection system 100 according to the invention comprises an element receptacle 1, an already positioned horizontal bar 20 the longitudinal direction of which extends into the plane of the drawing, and a second horizontal bar 20 to be attached which extends horizontally to the right, away from the element receptacle 1 in the illustration. In the illustrated state, the element receptacle 1 was already connected to the first horizontal bar 20 in its mounting position. Then, the receptacle 11 was rotated about the first spatial axis A1 so that the gripping surface 114 and the abutment surface 123 are oriented substantially perpendicular to each other in the illustrated state. Here, the gripping surface 114 already abuts on the broad side surface 21*a* of the first horizontal bar 20 facing downwards. The abutment surface 123 abuts on the high side wall 21*b* directed towards the right. It can be seen that, in the illustrated state, the first clamping surface S1 does not yet abut on the first horizontal bar 20. Moreover, the second clamping surface S2 does not yet abut on the connection interface 22 of the second horizontal bar 20. Therefore, the illustrated state shows a position of the element receptacle 1 which is in-between the mounting position and the operative position. On side of the second horizontal bar 20 facing the element receptacle 1, a connection interface 22 is disposed. This connection interface 22 comprises a plurality of sub-sections. A first section which is oriented downwards was already inserted into the receptacle interface 111 of the element receptacle 1 and extends through it. This first section is disposed at a small distance to the second clamping surface S2. A second section of the connection interface 22 already contacts the retainer 12. The second section abuts on the retainer 12 opposite of the abutment surface 123. The operating element 22*a* facing upwards can be seen. The circumference of the connection interface 22 can be changed by operating this operating element 22*a*. For operating the operating element 22*a*, it is moved upwards or downwards relative to the support pipe 21 of the horizontal bar 20. In the state illustrated in FIG. 6, the operating element 22*a* is not operated. For operating the operating element 22*a*, it is moved into the connection interface 22 in the direction of the support lug 21. The state illustrated in FIG. 6 can be transferred into the operative position of the connection system 100 illustrated in FIG. 7 by operating the operating element 22*a*.

FIG. 7 shows a side view of the first embodiment of a connection system 100 according to the invention in the operative position. In FIG. 7, the connection system 100 of FIG. 6 is illustrated in the operative position. In FIG. 7, the operating element 22*a* is in the operating state and inserted into the connection interface 22. For facilitating the operation of the operating element 22*a*, for example, the upper side of the operating element 22*a* can be stricken with a hammer. In the operative position, part of the operating element 22*a* protrudes from the receptacle interface 111 in the basic body 110 on the lower side. In the state illustrated in FIG. 7, the dimensions of the circumference of the section of the connection interface 22 located in the connection interface 111 are larger than in the state illustrated in FIG. 6. In this way, the receptacle 11 was drawn to the right in the illustration towards the second horizontal bar 20. This drawing took place via a surface of the connection interface 22 contacting a surface inside the connection interface 11. With the operation of the operating element 22*a*, the receptacle 11 was moved relative to the retainer 12 parallel to the second spatial axis A2. In this way, the first clamping surface S1 was also drawn in the direction of the abutment surface 123, and the second clamping surface S2 was drawn in the direction of the first section of the connection interface 22.

In the operative position illustrated in FIG. 7, therefore, now a positive connection and a non-positive connection exist between the element receptacle 1 and the first horizontal bar 20 as well as the second horizontal bar 20. The first horizontal bar 20 is now clamped between the first clamping surface S1 and the abutment surface 123. At the same time, the second section of the connection interface 22 abuts on the side of the retainer 12 disposed opposite of the abutment surface 123. Therefore, a flow of forces from the first clamping surface S1 through the first horizontal bar 20 to the retainer 12 and from there to the connection interface 22 of the second horizontal bar 20 is produced. This results in a clearance-free, particularly stable connection. In addition, the first section of the connection interface 22 facing downwards exerts pressure on the second clamping surface S2 so that a clamping force is guided through a second path, namely, from the section of the connection interface 22 facing downwards through the second clamping section 113*b* to the receptacle 11. Therefore, the components of the connection system 100 are non-positively connected or clamped to each other by two flows of forces guided through different paths. For deinstalling the connection system 100, the operating element 22A, starting from its operative position illustrated in FIG. 7, is moved back upwards again so that the clamping among the three components is released. In the unclamped state, the components can then again be separated from each other in the reverse order as previously described.

FIG. 8 shows a perspective view of a second embodiment of an element receptacle 1 according to the invention. The second embodiment shown in FIG. 8 is distinct from the embodiment shown in FIG. 3 in the design of the mating joint region 122 and of the joint region 112. The other components of the second embodiment, particularly the clamping region 113, the attaching element 121, the receptacle interface 111, the gripping surface 114, and the abutment surface 123 have a design identical to the first embodiment and will therefore not be described in detail again. In the second embodiment, the mating joint region 122 of the retainer 12 is implemented in two parts. The retainer 12 comprises two limbs 124 oriented perpendicular to the abutment surface 123. The mating joint region 122 is formed by two recesses disposed in respectively one of the limbs 124. The two limbs 124 are disposed adjacent to the abutment surface 123. The limbs 124 protrude beyond the side of the retainer 12 facing away from the abutment surface 123. The limbs 124 also protrude beyond the abutment surface 123 on the side facing away from the attaching element 121. In the illustrated embodiment, the two limbs 124 are formed by separate components other than the component on which the abutment surface 123 is disposed. When the element receptacle 1 is assembled, the two limbs 124 are fixedly connected to the component on which the abutment surface 123 is disposed, for example, by a weld connection. Alternatively, it is also possible to implement the limbs 124 as sections of the same component also including the abutment surface 123. The orientation of the limbs 124 perpendicular to the abutment surface 123 may, in this case, be realised by reshaping, for example by bending. Here, the two limbs 124 are designed in a key shape and comprise a rod-shaped part facing upwards in the illustration which is connected to the component on which the abutment surface 123 is disposed. The lower part of the limbs is designed to be wider than the upper part. The recesses forming the mating joint region 122 are disposed in the wider, lower part the limbs 124. In the second embodiment, the joint region 112 of the receptacle 11 is also disposed on basic body 110 and is located between the receptacle interface 111 and the clamping region 113. The joint region 112 is formed by two protrusions here which protrude to the outside on basic body 110 parallel to the gripping surface 114 and to the two clamping surfaces S1 and S2. The two protrusions forming the joint region 112 are implemented as studs having a rectangular cross-section here. The protrusions forming the joint region 112 are inserted into the recesses forming the mating joint region 122. Here, a positive connection with a clearance is established which results in that the receptacle 11 and retainer 12 cannot be separated from each other but movability among the two components is given. During the assembly or the installation of the element receptacle 1, first one of the two limbs 124 can be fixedly connected to the part of the retainer 12 on which the abutment surface 123 is disposed. In the next step, the receptacle is connected to the retainer 12 by one of the protrusions belonging to joint region 112 being inserted into the recess of the already attached limb 124. Finally, the second limb 124 is connected to the second joint region 112 and fixedly connected to the component on which the abutment surface 123 is disposed.

FIG. 9 shows a side view of the second embodiment of an element receptacle 1 in the operative position. In this side view, the second embodiment of the element receptacle 1 of FIG. 8 can be seen. In this view, it can be seen that the protrusions forming the joint region 112 have a rectangular cross-section. The recesses forming the mating joint region 122 have a complex shape here. The area of the recesses disposed on the lower side in the illustration has a rectangular cross-section. However, this rectangular cross-section is dimensioned so that it is larger than the rectangular cross-section of the protrusions forming the joint region. The width of the rectangular area of the recesses extending from the left to the right in the illustration is larger than the width of the protrusion forming the joint region 112. In this way, the joint region 112 can be linearly shifted in the mating joint region 122 along the second spatial axis A2. This relative shiftability along the second spatial axis A2 is required for producing a flow of forces between the element receptacle 1 and an already positioned scaffolding element. The interrelations for the production of this non-positive connection previously described based on the example of the first embodiment are analogously also applicable to the illustrated second embodiment. The recesses forming the mating joint region comprise a directly adjoining triangular area above the rectangular area. Owing to this triangular area, it is possible to rotate the protrusions forming the mating joint region 123 relative to the recesses forming the mating joint region 122 about the first spatial axis A1. Owing to this rotatability about the first spatial axis A1, the element receptacle can be transferred into the mounting position from the operative position illustrated in FIG. 9. For the transition of the element receptacle 1 from the operative position to the mounting position and vice versa, the interrelations previously described for the first embodiment analogously also apply to the second embodiment. The cross-sections of the protrusions forming the mating joint region 112 and the cross-sections of the recesses forming the mating joint region 122 may also have shapes different from the illustrated embodiment as long as movability in the form of rotatability about the first spatial axis A1 and linear shiftability along the second spatial axis A2 is possible. In the second embodiment, the second clamping section 113*b* has a more stable design than the second clamping section 113*b* in the first embodiment. In the second clamping section 113*b*, a larger section has a wedge-shaped design and a larger bending cross-section than in the first embodiment. The second clamping section 113*b* according to the second embodiment is designed to be more resistant to bending than in the first embodiment. Such a second clamping section 113*b* may also be combined with the first embodiment.

FIGS. 10 to 13 show various states during the attachment or installation of a connection system 100 to or on an already positioned scaffolding portion. Here, these views partially show process steps of the disclosed method.

FIG. 10 shows a perspective view of a first state during the attachment of an embodiment of a connection system 100 to an already positioned scaffolding portion. Here, the already positioned scaffolding portion comprises a vertical post 30 illustrated on the right side to which two horizontally oriented horizontal bars 20 which are part of a frame are attached. On the horizontal bar 20 illustrated in the front, an element receptacle 1 according to the first embodiment is attached in the illustrated state. In the illustrated state, the attaching element 121 is already partly guided over the broad side wall 21*a* of the support pipe 21 of the horizontal bar 20 directed upwards. The element receptacle 1 is in the mounting position and can therefore be guided over the support pipe 21 of the horizontal bar 20. Starting from the state illustrated in FIG. 10, the first clamping section 113*a* is guided past below the broad side wall 21*a* facing downwards until the first clamping section 113*a* is located on the side of the support pipe 21 facing backwards in the view. The illustrated state corresponds to process steps B) and C) of the disclosed method for mounting a scaffolding portion on an already positioned scaffolding portion.

FIG. 11 shows a perspective view of a second state during the attachment of an embodiment of a connection system 100 to an already positioned scaffolding portion. In the state illustrated in FIG. 11, the receptacle 11 was already partly rotated relative to the retainer 12 about the first spatial axis A1. However, in the illustrated state, the gripping surface 114 does not yet abut on the broad side wall 21*a* facing downwards. In FIG. 11, a second horizontal bar 20 is illustrated which faces rightwards and constitutes a further scaffolding element to be attached here. A connection interface 22 of the second horizontal bar 20 was already partly inserted into the connection interface 111 of the element receptacle 1. The state illustrated in FIG. 11 corresponds to process steps D) and E) of the disclosed method.

FIG. 12 shows a perspective view of a third state during the attachment of an embodiment of a connection system 100 to an already positioned scaffolding portion. In the state illustrated in FIG. 12, the receptacle 11 was further rotated about the first spatial axis A1 so that the gripping surface 114 abuts on the broad side wall 21*a* facing downwards. In the illustrated state, the element receptacle 1 encloses the support pipe 21 of the already positioned horizontal bar 20 so that the element receptacle 1 can no longer be separated from the horizontal bar 20. In FIG. 12, the connection interface 22 of the second horizontal bar 20 to be attached is inserted further into the receptacle interface 111 than in FIG. 11. In the state illustrated in FIG. 12, there is already a positive connection between the element receptacle 1, the already positioned horizontal bar 20, and the second horizontal bar 20 to be attached. However, in this state, the components are not yet clamped to each other and still exhibit a clearance relative to each other. In the state shown in FIG. 12, the operating element 22*a* is in a not yet operated state and protrudes upwards beyond the horizontal bar 20. For transferring the connection system 100 and the element receptacle 1 into the clamped operative position, the operating element 22*a* is operated by being inserted into the connection interface 22. The state illustrated in FIG. 12 corresponds to the end of process step E) of the disclosed method.

FIG. 13 shows a perspective view of a fourth state during the attachment of an embodiment of a connection system 100 to an already positioned scaffolding portion. In the state shown in FIG. 13, the operating element 22*a* of the connection interface 22 was operated by being inserted into the horizontal bar 20. With this operation of the operating element 22*a*, the cross-sectional area of the connection interface 22 disposed in the receptacle interface 111 was enlarged. With this enlargement of the cross-sectional area, the receptacle 11 was shifted relative to the retainer 12 parallel to the second spatial axis A2. With this shift, the already positioned first horizontal bar 20 was in turn clamped between the first clamping surface S1 and the abutment surface 123. Moreover, a contact was established between the second clamping surface S2 and the part of the connection interface 22 protruding downwards through the receptacle interface 111. In the illustrated state, in addition to the positive connection, there is now also a non-positive connection between the components element receptacle 1, first horizontal bar 20, and second horizontal bar 20 to be attached. These components are clamped to each other and therefore attached to each other without a clearance. The state illustrated in FIG. 13 corresponds to the completion of process step F) of the disclosed method.

LIST OF REFERENCE NUMERALS

1 Element receptacle
100 Connection system
11 Receptacle
110 Basic body
111 Receptacle interface
112 Joint region
113 Clamping region
113*a* First clamping section
113*b* Second clamping section
114 Gripping surface
115 Connecting element
115*a* Aperture
12 Retainer
121 Hook
121*a* Base
121*b* Retaining area
121*c* Retaining surface
122 Mating joint region
123 Abutment surface
124 Limb
20 Horizontal bar
21 Support pipe
21*a* Broad side wall
21*b* High side wall
22 Connection interface
22*a* Operating element
30 Vertical post
A1 First spatial axis
A2 Second spatial axis
S1 First clamping surface
S2 Second clamping surface

The invention claimed is:

1. An element receptacle for providing a receptacle for a scaffolding element on a scaffolding element already positioned comprising:

a receptacle which has a receptacle interface for receiving a scaffolding element which also has at least one joint region disposed adjacent to the receiving interface, and which also has a clamping region disposed adjacent to the joint region on the side of the receptacle opposite the receptacle interface, a retainer which has an attaching element for attaching to a scaffolding element already positioned and which also has at least one mating joint region, wherein the joint region of the receptacle is inserted into the mating joint region of the retainer, or the mating joint region of the retainer is inserted into the joint region of the receptacle, and, by an operative connection between the joint region and the mating joint region, the receptacle is guided for rotation relative to the retainer about at least one first spatial axis, and wherein the retainer comprises an abutment surface disposed on the side of the retainer facing away from the receptacle interface, and the attaching element protrudes beyond the abutment surface on the side of the retainer facing away from the receptacle interface, and the attaching element and the mating joint region are disposed on opposite sides of the abutment surface, and wherein the receptacle comprises a gripping surface disposed on the side of the receptacle facing the attaching element, wherein the receptacle interface and the clamping region are disposed on opposite sides of the gripping surface, wherein a first clamping section of the clamping region protrudes beyond the gripping surface in the direction of the attaching element, and a second clamping section protrudes beyond the surface disposed opposite of the gripping surface.

2. The element receptacle according to claim 1, wherein due to the operative connection between joint region and mating joint region, the receptacle is guided so that it is linearly movable relative to the retainer along at least one second spatial axis.

3. The element receptacle according to claim 1, wherein, the receptacle comprises a disc- or tongue-shaped basic body comprising the receptacle interface and the joint region, and wherein the clamping region is fixedly connected to the basic body and the gripping surface is formed by a surface of the basic body and provided to at least sectionally enclose a surface of the already positioned scaffolding element, wherein the gripping surface is defined by the connection interface on one side and by the protruding first clamping section on the opposite side.

4. The element receptacle according to claim 1, wherein, the first clamping section comprises a first clamping surface disposed adjacent to the gripping surface and oriented perpendicular to the gripping surface, wherein the first clamping surface is provided for the abutment on a surface of the already positioned scaffolding element.

5. The element receptacle according to claim 1, wherein, the second clamping section comprises a second clamping surface provided for the abutment on a surface of the scaffolding element to be accommodated on its side facing away from the basic body, wherein the second clamping surface is oriented perpendicular to the gripping surface.

6. The element receptacle according to claim 1, wherein, the mating joint region is implemented as a recess in the retainer, and the joint region is implemented as a section of the basic body of the receptacle, wherein the mating joint region implemented as a recess has a length and a width which are larger than the length and the width of the joint region implemented as a section of the basic body, and the joint region is inserted into the mating joint region, wherein the mating joint region encloses the joint region.

7. The element receptacle according to claim 6, wherein, the receptacle comprises at least one connecting element connected to the basic body and/or the clamping region, wherein the connecting element is disposed on the side of the basic body disposed opposite of the gripping surface, and the connecting element comprises an aperture which is open on the side facing the basic body, wherein the open side of the aperture at least partly bridges the joint region, and the aperture encloses an area of the retainer disposed adjacent to the mating joint region together with the joint region.

8. The element receptacle according to claim 1, wherein, the two recesses forming the mating joint region are disposed in respectively one limb of the retainer, wherein the limbs are disposed on two opposite sides of the abutment surface, extend perpendicular to the abutment surface, and protrude beyond the side of the retainer disposed opposite of the attaching element.

9. The element receptacle according to claim 1, wherein, a mounting position and an operative position of the element receptacle are provided, wherein the element receptacle is connectable to and detachable from the already positioned scaffolding element in the mounting position, and the element receptacle is fixed to the already positioned scaffolding element in the operative position and wherein in the operative position, the abutment surface is oriented perpendicular to the gripping surface, and the clamping surfaces are oriented parallel to the abutment surface.

10. The element receptacle according to claim 1, wherein, starting from the operative position, the element receptacle is transferrable into the mounting position by a linear movement parallel to the second spatial axis and by a rotational movement about the first spatial axis of the receptacle relative to the retainer.

11. The element receptacle according to claim 1, wherein, in the mounting position, the abutment surface assumes an angle of more than 90° to the gripping surface, and the clamping surfaces are oriented to the abutment surface at an angle other than 0°.

12. A connection system for connecting a scaffolding portion to an already positioned scaffolding portion comprising:

at least one element receptacle according to claim 1, at least one first horizontal bar constituting a part of the already positioned scaffolding portion, wherein the horizontal bar comprises a support pipe which has a rectangular cross-section and is defined by two broad side surfaces and two high side surfaces in the circumferential direction, and wherein respectively one connection interface is disposed on the front sides of the support pipe, wherein the element receptacle is fixedly connectable to the horizontal bar in its operative position, wherein the abutment surface abuts on a high side wall, the first clamping surface abuts on the opposite high side wall, and the gripping surface and/or the surface of the attaching element disposed opposite of the gripping surface abuts on a broad side wall.

13. The connection system according to claim 12, wherein, the abutment surface, the gripping surface, the attaching element, and the first clamping region form an undercut positively enclosing the support pipe in its cross-section in the operative position.

14. The connection system according to claim 12, wherein, a second horizontal bar is provided which is part of the scaffolding portion connected or to be connected, wherein a connection interface of the horizontal bar is inserted into the receptacle interface of the element receptacle.

15. The connection system according to claim 12, wherein, in the operative position, respectively one surface of the connection interface of the second horizontal bar abuts on the second clamping surface and the surface of the retainer disposed opposite of the abutment surface.

16. The connection system according to claim 12, wherein, during the insertion of the connection interface of the second horizontal bar into the receptacle interface of the element receptacle, the connection interface moves the receptacle interface away from the retainer along the second spatial axis and thereby clamps the support pipe between the first clamping surface and the abutment surface in a direction parallel to the broad side wall.

17. A method for mounting a scaffolding portion on an already positioned scaffolding portion using at least one element receptacle according to claim 1 comprising the steps of:

transferring the element receptacle into the mounting position, positioning the element receptacle on a horizontal bar of the already positioned scaffolding portion so that the attaching element, in combination with the abutment surface, encloses a first broad side wall of the horizontal bar, guiding the first clamping section past the second broad side wall disposed opposite of the first broad side wall so that the gripping surface, in combination with the first clamping region, encloses the second broad side wall, rotating the receptacle relative to the retainer about the joint formed of the joint region and the mating joint region about the first spatial axis until the gripping surface abuts on the second broad side wall of the horizontal bar disposed opposite of the attaching element, inserting a connection interface of a horizontal bar which is part of the scaffolding portion to be attached into the receptacle interface of the element receptacle, linearly moving the connection interface parallel to the receiving surface in the direction from the attaching element towards the clamping region, wherein, due to the contact of the connection interface to the receptacle interface, the receptacle, guided by the joint formed by the joint region and the mating joint region, is linearly moved away from the retainer along the second spatial axis until the horizontal bar is non-positively clamped between the first clamping surface and the abutment surface and the operative position is reached thereby.

18. The method according to claim 17, wherein, during the linearly moving, the second clamping surface contacts the connection interface and is pressed against the connection interface when the operative position is reached.

19. The method according to claim 17, wherein, during the linearly moving, an operating element of the connection interface is operated so that the shape of the connection interface, particularly a circumference of the connection interface, is changed and/or enlarged.

* * * * *